US012677908B2

(12) United States Patent
Nishi

(10) Patent No.: US 12,677,908 B2
(45) Date of Patent: Jul. 14, 2026

(54) ANTI-SLIP MEMBER FOR WEARABLE EQUIPMENT OR SPORTS EQUIPMENT, WEARABLE EQUIPMENT, AND SPORTS EQUIPMENT

(71) Applicant: ASICS CORPORATION, Kobe (JP)

(72) Inventor: Toshiaki Nishi, Kobe (JP)

(73) Assignee: ASICS CORPORATION, Kobe (JP)

( * ) Notice: Subject to any disclaimer, the term of this patent is extended or adjusted under 35 U.S.C. 154(b) by 114 days.

(21) Appl. No.: 18/248,685

(22) PCT Filed: Oct. 23, 2020

(86) PCT No.: PCT/JP2020/039913

§ 371 (c)(1),
(2) Date: Apr. 11, 2023

(87) PCT Pub. No.: WO2022/085180

PCT Pub. Date: Apr. 28, 2022

(65) Prior Publication Data

US 2023/0389652 A1 Dec. 7, 2023

(51) Int. Cl.
*A43B 13/22* (2006.01)
*A43B 13/04* (2006.01)

(52) U.S. Cl.
CPC ..... *A43B 13/22* (2013.01); *A43B 13/04* (2013.01)

(58) Field of Classification Search
CPC ..... A43B 13/22
See application file for complete search history.

(56) References Cited

U.S. PATENT DOCUMENTS 2,997,746 A * 8/1961 O'Brien ..... B29C 41/14 427/353
2005/0035493 A1 2/2005 Flather et al.
2006/0150300 A1 7/2006 Hassan et al.
2007/0118967 A1 5/2007 Flather et al.
2007/0192929 A1 8/2007 Flather et al.
2008/0244809 A1 10/2008 Hassan et al.
2011/0088140 A1 4/2011 Hassan et al.
2015/0143611 A1 5/2015 Megat Abdul Aziz et al.
2016/0360808 A1 12/2016 Flather et al.
(Continued)

FOREIGN PATENT DOCUMENTS

CN 106723647 A 5/2017
CN 110105640 A 8/2019
(Continued)

OTHER PUBLICATIONS

Notification of Transmittal of Translation of the International Preliminary Report on Patentability and Translation of Written Opinion of the International Searching Authority; PCT/2020/039913; mailed on May 4, 2023.

(Continued)

*Primary Examiner* — Alexandre F Ferre
(74) *Attorney, Agent, or Firm* — Studebaker Brackett PLLC

(57) ABSTRACT

Provided is an anti-slip member for wearable equipment or sports equipment, the anti-slip member composed of an elastomer composition including an elastomer and water-soluble particles dispersed in the elastomer. Also provided are wearable equipment and sports equipment including the anti-slip member.

8 Claims, 11 Drawing Sheets

(56) References Cited

U.S. PATENT DOCUMENTS

| | | | | |
|---|---|---|---|---|
| 2017/0000201 | A1 | 1/2017 | Flather et al. | |
| 2017/0150782 | A1* | 6/2017 | Moriyasu | A43B 13/181 |
| 2017/0318901 | A1 | 11/2017 | Nishi | |
| 2019/0380431 | A1* | 12/2019 | Sakamoto | C08K 5/548 |
| 2020/0008518 | A1 | 1/2020 | Souyri et al. | |
| 2022/0132988 | A1 | 5/2022 | Nishi | |

FOREIGN PATENT DOCUMENTS

| | | | |
|---|---|---|---|
| CN | 110325072 | A | 10/2019 |
| CN | 110628099 | A | 12/2019 |
| JP | H03-265636 | A | 11/1991 |
| JP | H10-005005 | A | 1/1998 |
| JP | 2005-087408 | A | 4/2005 |
| JP | 2011-137283 | A | 7/2011 |
| JP | 2012-184538 | A | 9/2012 |
| WO | 2016/076432 | A1 | 5/2016 |
| WO | 2018/193555 | A1 | 10/2018 |
| WO | 2020/178987 | A1 | 9/2020 |

OTHER PUBLICATIONS

International Search Report issued in PCT/JP2020/039913; mailed Dec. 28, 2020.

Database WPI Week 201747 Thomson Scientific, London, GB; AN 2017-39107K, XP002810107; and CN106723647A submitted herewith.

Database WPI Week 201969 Thomson Scientific, London, GB; AN 2019-70673P, XP002810108; and CN110105640A submitted herewith.

Database WPI Week 2020009 Thomson Scientific, London, GB; AN 2020-04604R, XP002810109; and CN110628099A submitted herewith.

The extended European search report issued by the European Patent Office on Sep. 21, 2023, which corresponds to European Patent Application No. 20958729.4-1102 and is related to U.S. Appl. No. 18/248,685.

An Office Action; "Notice of Reasons for Refusal," mailed by the Japanese Patent Office on Sep. 8, 2023, which corresponds to Japanese Patent Application No. 2022-556349 and is related to U.S. Appl. No. 18/248,685; with English language translation.

An Office Action; mailed by the China National Intellectual Property Administration of the People's Republic of China on Mar. 31, 2025, which corresponds to Chinese Patent Application No. 202080105434.1 and is related to U.S. Appl. No. 18/248,685.

An Office Action; mailed by the China National Intellectual Property Administration of the People's Republic of China on Aug. 18, 2025, which corresponds to Chinese Patent Application No. 202080105434.1 and is related to U.S. Appl. No. 18/248,685.

Office Action issued in CN 202080105434.1; mailed by the State Intellectual Property Office of the People's Republic of China on Jan. 12, 2026.

* cited by examiner

ANTI-SLIP MEMBER FOR WEARABLE EQUIPMENT OR SPORTS EQUIPMENT, WEARABLE EQUIPMENT, AND SPORTS EQUIPMENT

FIELD

The present invention relates to an anti-slip member for wearable equipment or sports equipment, wearable equipment, and sports equipment, and more specifically, to an anti-slip member for wearable equipment or sports equipment, which has improved wet-grip performance, and wearable equipment and sports equipment including the anti-slip member.

BACKGROUND

Players wear various wearable equipment or use various sports equipment for playing sports. There are some wearable equipment or sports equipment which are supposed to make contact with an object wet by water, such as a wet ground, ball or player's hand. When the equipment makes contact with the wet object, water interposed between the equipment and the object blocks direct contact between the equipment and the object and hence is likely to cause slippage therebetween.

Sports shoes as an example of the wearable equipment are sometimes used on the ground wet with water during or after rain. The ground wet with water is likely to cause slippage and may pose a risk of causing the wearer of the sports shoes to slip and fall on the ground when the wearer moves on the ground.

Further, in sports equipment such as a bat which is gripped by the player when in use, sweat of the player may occur or intrude between the grip of the sports equipment and the player's hand. The sweat present between the grip and the hand may cause slippage therebetween, which makes it hard for the player's hand to securely grip the bat. In some cases, sweat causes the bat to slip out of the player's hands.

Therefore, there is a demand for an anti-slip member that can exhibit sufficient grip performance, that is, high wet-grip performance by being incorporated with the wearing equipment or sports equipment which are supposed to make contact with the wet object, and thereby suppressing slippage between itself and the wet object.

In prior arts, there are conventionally known shoe soles disclosed in, for example, Patent Literatures 1 to 4 below as an anti-slip member that has improved wet-grip performance and is intended to be used for the wearable equipment or sports equipment. Patent Literature 1 discloses a rubber and/or resin foam for a shoe sole incorporated with chips or pieces produced by polishing or cutting leather. This foam for the shoe sole has improved wettability with water and thereby has high wet-grip performance by the incorporated chips or pieces produced by polishing or cutting leather having high water absorbability. Patent Literature 2 discloses an outer sole formed of a viscoelastic material including rubber. This outsole has increased wet-grip performance by adjusting the loss factor and the storage elastic modulus in dynamic viscoelasticity measurement of the viscoelastic material, and adjusting the tensile stress of the viscoelastic material to thereby enable the viscoelastic material to have increased viscosity. Patent Literature 3 discloses an outer sole formed of a composition including a thermoplastic elastomer. This outer sole has increased wet-grip performance by increasing surface free energy of the composition and thereby suppressing formation of a liquid film between the surface of the composition and a road surface. Patent Literature 4 discloses an anti-slip member composed of an elastomer composition in which a hydrogel is dispersed on a surface of an elastomer. This anti-slip member has increased wet-grip performance by trapping with hydrogel water present at the interface between a surface of the anti-slip member and an object to thereby increase the contact area between the elastomer of the surface and the object.

CITATION LIST

Patent Literature

Patent Literature 1: JP 2005-087408 JP
Patent Literature 2: WO 2018/193555 A
Patent Literature 3: WO 2016/076432 A
Patent Literature 4: WO 2020/178987 A

SUMMARY

Technical Problem

While various anti-slip members as mentioned above have been proposed, there are ongoing demands for an anti-slip member that is widely applicable to various wearable equipment or sports equipment and has more improved wet-grip performance, and wearable equipment and sports equipment that have more improved wet-grip performance.

In view of the aforementioned problem, it is an object of the present invention to provide an anti-slip member for wearable equipment or sports equipment having improved wet-grip performance, and wearable equipment and sports equipment including the anti-slip member.

Solution to Problem

An anti-slip member for wearable equipment or sports equipment according to the present invention is composed of an elastomer composition including an elastomer and water-soluble particles dispersed in the elastomer.

Wearable equipment or sports equipment according to the present invention includes the aforementioned anti-slip member.

DESCRIPTION OF EMBODIMENTS

Hereinafter, an embodiment of an anti-slip member for wearable equipment or sports equipment, and an embodiment of sports equipment, of the present invention will be described with reference to the drawings. The following embodiments are shown merely as examples. The present invention is not limited to the following embodiments at all.

(Anti-Slip Member)

Figure 1:
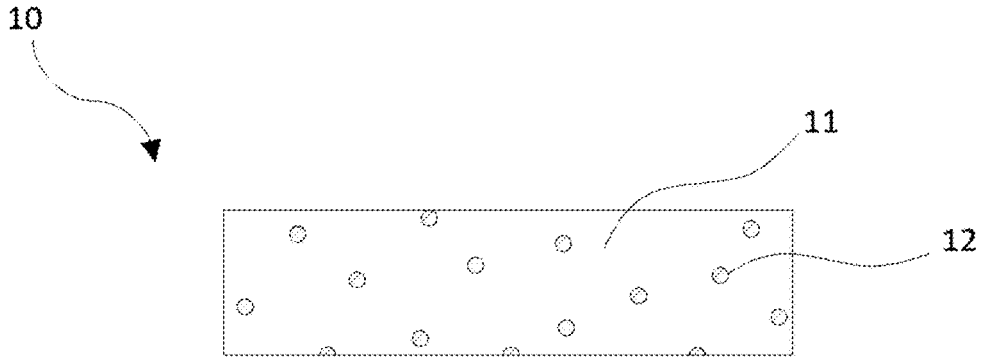
FIG. 1 is a lateral cross-sectional view of an anti-slip member for wearable equipment or sports equipment of one embodiment.

First, an anti-slip member for wearable equipment or sports equipment of the present invention will be described with reference to FIG. 1 to FIG. 3. FIG. 1 is a lateral cross-sectional view of an anti-slip member 10 for wearable equipment or sports equipment of this embodiment. The anti-slip member 10 of this embodiment is composed of an elastomer composition including an elastomer 11 and water-soluble particles 12 dispersed in the elastomer 11, and the water-soluble particles 12 are dispersed in the anti-slip member 10. The wearable equipment as used herein means equipment, which a user (wearer) wears or carries when in use, and examples of which include exercise shoes, work shoes, cold-proof shoes, daily shoes, a wear, a glove, and spectacles. The sports equipment as used herein means equipment, which a user uses for exercises (in particular, as a form to be gripped by the user), and equipment not included in the aforementioned wearable equipment, examples of which include a bat, a racket, and a golf club (the anti-slip member of the present invention is provided mainly on grips of these items of goods). Examples of the equipment further include a grip and a grip tape to be supplied to these items of the goods. The term "exercise" as used herein means whole physical activities, that is, human physical activities, examples of which include physical activities involved in sports, athletics, exercises, recreations, or the like.

The water-soluble particles 12 dispersed in the elastomer 11 are partially exposed on the surface of the anti-slip member 10. The "surface" of the anti-slip member as used herein means an exterior boundary at which the elastomer composition of the anti-slip member makes contact with an object when the anti-slip member is provided in wearable equipment or sports equipment. For example, when the anti-slip member is provided in a shoe sole of a shoe, the surface of the anti-slip member means an exterior boundary at which the anti-slip member makes contact with the ground, and does not include the exterior boundary at which the anti-slip member is bonded to the shoe and do not make contact with the ground. Hereinafter, a region of the anti-slip member 10 that includes the water-soluble particles 12 exposed on the surface of the anti-slip member 10 and that extends in a thickness direction from the surface of the anti-slip member 10 to the deepest position at which these water-soluble particles 12 are present can be referred to as a surface layer region of the anti-slip member 10. A description will be hereinafter given on the example of the anti-slip member 10 shown in each of FIGS. 1 to 3, with a lower surface of the anti-slip member 10 in each of FIGS. 1 to 3 defined as the surface of the anti-slip member 10.

The water-soluble particles 12 exposed on the surface of the anti-slip member 10 dissolve and disappear from the surface when the surface becomes wet with water. Then, recesses C are formed as a result of disappearance of the water-soluble particles 12 on portions of the surface of the anti-slip member 10 in which the respective water-soluble particles 12 were present. FIG. 2 is a lateral cross-sectional view of the anti-slip member 10 after those water-soluble particles 12 exposed on the surface of the anti-slip member 10 shown in FIG. 1 disappear. As shown in FIG. 2, the recesses C are formed on the portions of the surface of the anti-slip member 10 in which the respective water-soluble particles 12 were present. The recesses C thus formed on the surface of the anti-slip member 10 each allow a slight amount of air A to be held thereinside. The anti-slip member of this embodiment has a function to allow the air A to be held inside the recesses C, thereby achieving increased wet-grip performance. The mechanism thereof will be discussed later. Unless otherwise specified, the term "water" as used herein includes any given aqueous liquid (e.g., rainwater or perspiration) that could cause slippage between an object and the wearable equipment or the sports equipment provided with the anti-slip member.

Figure 2:
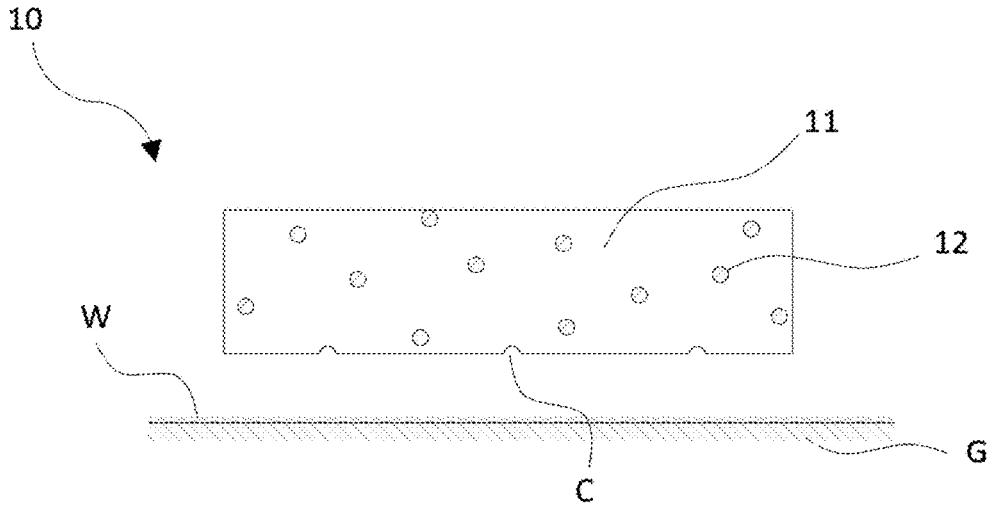
FIG. 2 is a lateral cross-sectional view of the anti-slip member after water-soluble particles exposed on a surface of the anti-slip member in FIG. 1 disappear.

As shown in FIG. 2, when the water-soluble particles 12 exposed on the surface of the anti-slip member 10 have disappeared, the surface layer region of the anti-slip member 10 can be defined as a region that includes the recesses C as a result of the disappearance of the water-soluble particles 12 and that extends in the thickness direction from the surface of the anti-slip member 10 to the deepest position at which the recesses C are present. When not all those water-soluble particles 12 exposed on the surface of the anti-slip member 10 have disappeared but the surface of the anti-slip member 10 have both the water-soluble particles 12 and the recesses C, the surface layer region of the anti-slip member 10 can be defined as a region extending from the surface of the anti-slip member 10 to the deepest position in the thickness direction at which either the water-soluble particles 12 exposed on the surface or the recesses C are present.

The water-soluble particles 12 on the surface of the anti-slip member 10 can disappear from the surface for other reasons than dissolving in water, as long as the recesses C are formed when the anti-slip member is used (i.e., becomes wet with water). For example, the water-soluble particles 12 on the surface of the anti-slip member 10 can disappear simply by, for example, physically falling from the surface or being crushed.

Figure 3:
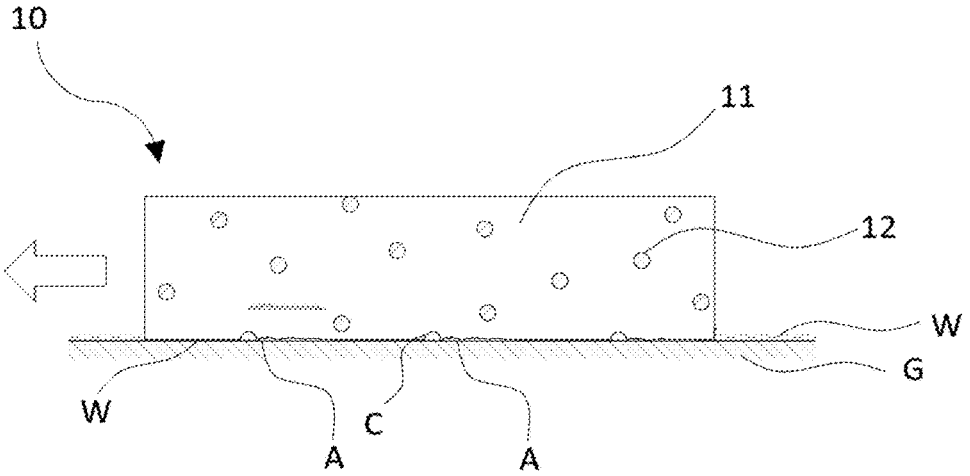
FIG. 3 is a schematic view showing the anti-slip member of FIG. 2 after it makes contact with an object wet with water.

FIG. 3 is a schematic view showing the anti-slip member 10 of this embodiment after it makes contact with an object G wet with water W. The object G is herein represented as a ground G wet with water W. This figure shows the state where the anti-slip member 10 is subjected to stress in the arrow direction to have strain applied to its interface with the ground G.

As described above, the recesses C capable of holding the air A thereinside are formed on the surface of the anti-slip member 10 from which the water-soluble particles 12 wet with water W have disappeared. The air A held in the recesses C is discharged from the recesses C to the interface when strain is applied to the interface between the ground G and the anti-slip member 10 having made contact with the ground G. Although only a slight amount of the air A is discharged at this time, the air A can still spread to a relatively large area of the interface since a gap is hardly formed between the ground G and the anti-slip member 10 having low elasticity. When the air A is present between the anti-slip member 10 and the ground G, such driving force as to minimize the sum of surface free energy acts to discharge water between the anti-slip member 10 and the ground G in the area in which the air A is present, thereby enabling a portion of the elastomer 11 exposed on the surface of the anti-slip member 10 to be in direct contact with the ground G. A large number of positions at which the elastomer 11 exposed on the surface of the anti-slip member 10 makes direct contact with the ground G without water present therebetween are thus formed to increase the contact area between the elastomer 11 and the object G. Therefore, the anti-slip member 10 of this embodiment can exhibit high grip performance to the object G wet with water W and thus has improved wet-grip performance.

The surface of the anti-slip member 10 may be worn away as it repeatedly makes contact with the object G. Then, the recesses C formed on the surface before being worn away are lost, but some of the water-soluble particles 12 further included in the anti-slip member 10 are to be newly exposed on the surface of the anti-slip member 10 after being worn away. When those water-soluble particles 12 newly exposed on the surface disappear by, for example, dissolving in water W, new recesses C are formed on the surface. Therefore, the anti-slip member 10 of this embodiment also has an advantage of high durability as an anti-slip member since it can maintain high wet-grip performance even when its surface is worn away as it is used.

The water-soluble particles 12 are particles made of a water-soluble substance that dissolves and disappears from the inside of the anti-slip member 10 when it is wet with water (e.g., rainwater or perspiration at 0° C. to 50° C.) supposed to make contact with the anti-slip member used for the wearable equipment or the sports equipment. Examples of the water-soluble substance include, but are not limited to, inorganic salts such as sodium chloride (salt), potassium chloride, zinc chloride, copper (II) chloride, iron (II) chloride, magnesium chloride, aluminum chloride, ammonium chloride, calcium chloride, and manganese (II) chloride; organic salts such as calcium acetate; and saccharides such as sucrose, glucose, maltose, lactose, and starch. These can be solely used, or two or more kinds of them can be used in combination with each other. Since the water-soluble substance dissolves in water or an aqueous liquid to be thereby eluted when the anti-slip member is used, it is preferable that the water-soluble substance be less harmful, ideally harmless, to human bodies, clothes, or the other outer environment when eluted.

It is preferable that the water-soluble particles 12 include inorganic salt particles as the water-soluble substance. The inorganic salt, which has relatively high heat resistance, has an advantage of being hardly subjected to chemical modification by heat at the time of producing the anti-slip member 10 (for example, heat in association with vulcanizing a rubber in the case where the elastomer 11 is a vulcanized rubber). It is particularly preferable that sodium chloride be selected as the inorganic salt.

The particle size of the water-soluble particles 12 is adjusted as appropriate so that the recesses C each having such a size as to be capable of effectively discharging air to the interface between the surface of the anti-slip member 10 and the wet object G can be formed on the surface. The average particle size of the water-soluble particles 12 included in the anti-slip member 10 is preferably 1 μm or more and 1000 μm or less, more preferably 10 μm or more and 100 μm or less. The average particle size of the water-soluble particles 12 included in the anti-slip member 10 falls within the above range to thereby more effectively increase the wet-grip performance of the anti-slip member 10.

In terms also of maintaining sufficient mechanical strengths of the anti-slip member 10, such as tensile strength, tear strength, or abrasion resistance, the average particle size of the water-soluble particles 12 included in the anti-slip member 10 is preferably 1000 μm or less, more preferably 100 μm or less. When the water-soluble particles 12 have a particle size that is too large, the mechanical strengths of the anti-slip member 10 are easily reduced by the water-soluble particles 12 present in the anti-slip member 10, which could cause the anti-slip member for the wearable equipment or the sports equipment to fail to exhibit the required mechanical strengths.

The average particle size of the water-soluble particles 12 included in the anti-slip member 10 can be determined by randomly selecting 10 or more particles of the water-soluble particles 12 seen on each of two or more randomly selected cross-sectional surfaces of the anti-slip member 10, taking these particles out of the cross-sectional surfaces to measure individually the major axis diameter of each of these particles, and arithmetically averaging the measured values obtained for them.

The proportion of the water-soluble particles 12 included in the anti-slip member 10 is preferably 1 volume % or more and 5 volume % or less, more preferably 2 volume % or more and 4 volume % or less, without limitation thereto. More suitably, it is preferable that the above proportion of the water-soluble particles 12 be included in an internal region, which is a portion of the anti-slip member 10 from which the surface layer region is excluded. In other words, the anti-slip member 10 includes the surface layer region having the recesses as a result of the disappearance of the water-soluble particles 12 and the internal region provided inside the surface layer region, and the proportion of the water-soluble particles 12 included in the internal region is preferably 1 volume % or more and 5 volume % or less, more preferably 2 volume % or more and 4 volume % or less. The proportion of the water-soluble particles 12 included in the anti-slip member 10 falls within the above range to thereby more effectively increase the wet-grip performance of the anti-slip member 10.

The proportion of the water-soluble particles 12 included in the anti-slip member 10 is preferably 5 volume % or less, more preferably 4 volume % or less, in terms also of maintaining sufficient mechanical strengths, such as tensile strength or tear strength, of the anti-slip member 10. When the proportion of the water-soluble particles 12 included in the anti-slip member 10 is too large, the mechanical strengths of the anti-slip member 10 are easily reduced by the water-soluble particles 12 present in the anti-slip member 10, which could cause the anti-slip member for the wearable equipment or the sports equipment to fail to exhibit the required mechanical strengths. Further, when the content of the water-soluble particles 12 in the anti-slip member 10 is excessive, larger portions of the water-soluble particles 12 make contact with each other in the anti-slip member 10. When those water-soluble particles 12 exposed on the surface of the anti-slip member 10 are wet with water to dissolve, water-soluble particles 12 in contact with the wet particles 12 directly or via other water-soluble particles 12 within the anti-slip member 10 may also dissolve in association with the wetting if excessively large portions of the water-soluble particles 12 make contact with each other. If this is the case, pores like those in a sponge occur in the regions in which the water-soluble particles 12 were present within the anti-slip member 10 once wet, which could possibly result in a significant reduction of the mechanical strengths of the anti-slip member 10.

The proportion in volume % of the water-soluble particles 12 included in the anti-slip member 10 can be determined by, for example, the following method: all those water-soluble particles 12 seen on each of two or more randomly selected cross-sectional surfaces of the anti-slip member 10 are caused to disappear (by, for example, being eluted by water), and thereafter the area of all recesses, which are formed as a result of the disappearance of the water-soluble particles 12, visible on each of the cross-sectional surfaces are for example observed using a microscope to calculate the total area ratio of the recesses to the cross-sectional surface. This measurement and calculation are performed for at least two or more cross-sectional surfaces, and the value obtained by raising the average of the respective calculated total area ratios to the power of 3/2 can be regarded as the proportion in volume % of the water-soluble particles 12 included in the anti-slip member 10. The content of the water-soluble particles 12 within the internal region, which is the portion of the anti-slip member 10 from which the surface layer region is excluded, can be measured for the anti-slip member 10 after scraping off the surface of the anti-slip member 10 in a uniform thickness until the recesses as a result of the disappearance of the water-soluble particles 12 become no longer visible (e.g., to a depth of 100 μm from the surface) to remove the surface layer region.

It is preferable that the water-soluble particles 12 dispersed in the elastomer 11 of the anti-slip member 10 be substantially uniformly dispersed in the elastomer 11. Since the water-soluble particles 12 are uniformly dispersed in the elastomer 11, the water-soluble particles 12 or the recesses C are also substantially uniformly dispersed over the entire surface of the anti-slip member 10. This configuration allows air discharged from the recesses C to be widely present between the surface of the anti-slip member 10 and the object G in the entire surface of the anti-slip member 10. Therefore, the wet-grip performance can be more effectively increased in the entire surface of the anti-slip member 10. In the anti-slip member 10, the water-soluble particles 12 or the recesses C do not necessarily have to be dispersed over the entire surface of the anti-slip member 10. Even if the water-soluble particles 12 or the recesses C are unevenly dispersed in a certain region of the surface of the anti-slip member 10, the wet-grip performance of the wet-grip member 10 can still be increased.

An elastomer generally used as an anti-slip material, which can exhibit sufficient grip performance to the object with which the elastomer makes contact, is used as the elastomer 11. Examples of the elastomer include a vulcanized rubber such as a natural rubber (NR), an isoprene rubber (IR), a butadiene rubber (BR), a styrene butadiene rubber (SBR), a chloroprene rubber (CR), an acrylonitrile butadiene rubber (NBR), a butyl rubber (IIR), and a silicone rubber (Si); and a thermoplastic elastomer such as a styrene-based elastomer (TPS), an olefin-based elastomer (TPO), a urethane-based elastomer (TPU), a polyester-based elastomer (TPEE), polyamide-based elastomer (TPA), polyvinyl chloride (PVC), and an ethylene-vinyl acetate copolymer (EVA). These can be solely used, or two or more kinds of them can be used in combination with each other.

It is preferable that an appropriate elastomer be selected as the elastomer 11 according to the characteristics required for the wearable equipment or sports equipment for which the anti-slip member is used. For example, when the anti-slip member is used for a shoe sole of a shoe, BR, SBR, NR, or IR, which is excellent in tensile strength, tear strength, and abrasion resistance, is appropriately selected as the elastomer 11.

The hardness of the elastomer 11 of this embodiment can be appropriately set according to the intended use of the anti-slip member. For example, when the anti-slip member is used for a shoe sole of a shoe, the hardness of the elastomer 11 is preferably in a range of 55 to 75 in the type A durometer hardness according to JIS K 6253-3:2012. For the anti-slip member used for the grip of a bat or racket, or used for a glove or wear, the hardness of the elastomer 11 is preferably in a range of 40 to 60 in the type A durometer hardness. The wet-grip performance of the anti-slip member 10 achieved by the water-soluble particles 12 included therein tends to be more remarkably improved as the elastomer 11 has a lower hardness. In this regard, it is more preferable that the hardness of the elastomer 11 be a type A durometer hardness of 65 or less.

The wet-grip performance of the anti-slip member 10 achieved by the water-soluble particles 12 included therein tends to be more remarkably improved as the elastomer 11 has a lower initial elastic modulus (tensile elastic modulus). In this regard, the initial elastic modulus of the elastomer 11 is preferably 20 MPa or less, more preferably 10 MPa or less. The initial elastic modulus of the elastomer 11 is preferably 1 MPa or more. The initial elastic modulus of the elastomer 11 can be determined from the gradient of the stress-strain curve in a low-strain area in the tensile test according to JIS K6251:2017 "Rubber, vulcanized or thermoplastic—Determination of tensile stress-strain properties" (for example, gradient of the stress-strain curve corresponding to a portion between two strain points of $\varepsilon 1=0\%$ and $\varepsilon 2=5\%$).

The elastomer 11 can be a non-foamed product or a foamed product as long as the recesses C, which are formed as a result of the disappearance of the water-soluble particles 12 and have substantially the same size as the water-soluble particles 12, can be formed on the surface thereof. Nevertheless, the elastomer 11 included in the anti-slip member 10 is preferably a non-foamed product since the surface of the anti-slip member 10 desirably has a flat surface capable of making contact with the object G to increase its contact area with the object G near each of the disappearing portions of the water-soluble particles 12. In this embodiment, the elastomer 11 is depicted as a non-foamed product.

The anti-slip member 10 can further include an inorganic filler such as silica, alumina, calcium carbonate, magnesium carbonate, carbon black, graphite, talc, or clay. When a portion of the anti-slip member 10 other than the water-soluble particles 12 is considered as a matrix, the matrix itself preferably has hydrophilicity. Thus, an inorganic filler excellent in hydrophilicity is suitably included in the anti-slip member 10. As the inorganic filler included in the anti-slip member 10, suitably selected is silica in a particulate form having a surface on which a number of silanol groups (—Si—OH) each as a hydrophilic functional group are present.

The silica can be a wet silica or a dry silica. The wet silica can be a precipitated silica, a gelled silica, or a colloidal silica. The dry silica can be a fumed silica or an arc silica. The silica is preferably the wet silica. It is preferable that the wet silica include aggregated particles each formed to have a plurality of primary particles of about 20 nm aggregated with each other. The wet silica is preferably the precipitated silica, which includes a large number of aggregated particles easily decomposed into the primary particles, in terms of being easily handled and excellent in dispersibility of the primary particles into rubber.

The content of silica in the anti-slip member 10 is preferably 10 mass parts or more based on 100 mass parts of the elastomer 11. The content of the silica is more preferably 20 mass parts or more, still more preferably 30 mass parts or more. The content of the silica in the anti-slip member 10 is preferably 100 mass parts or less based on 100 mass parts of the elastomer 11. The content of the silica is more preferably 90 mass parts or less, still more preferably 80 mass parts or more.

It is preferable that the anti-slip member 10 include a silane coupling agent together with the silica. The configuration can be such that the silane coupling agent in this embodiment has a hydrolyzable functional group at an end of the molecular chain, and further has an organic functional group other than the hydrolyzable functional group. The hydrolyzable functional group can be an alkoxy group, a phenoxy group, a carboxyl group, an alkenyloxy group, or the like. The organic functional group can be an epoxy group, a vinyl group, an acryloyl group, a methacryloyl group, an amino group, a sulfide group, a mercapto group, or the like. The silane coupling agent in this embodiment preferably has a sulfide group. That is, the silane coupling agent in this embodiment is preferably a sulfide-based silane coupling agent. The sulfide-based silane coupling agent can be a monosulfide-based silane coupling agent or a polysulfide-based silane coupling agent.

Examples of the sulfide-based silane coupling agent include bis(3-triethoxysilylpropyl)tetrasulfide, bis(3-trimethoxysilylpropyl)tetrasulfide, bis(3-triethoxysilylpropyl)disulfide, mercaptopropyltrimethoxysilane, mercaptopropyltriethoxysilane, 3-trimethoxysilylpropyl-N,N-dimethylthiocarbamoyl-tetrasulfide, trimethoxysilylpropylmercaptobenzothiazoltetrasulfide, triethoxysilylpropylmethacrylate-monosulfide, dimethoxymethylsilylpropyl-N,N-dimethylthiocarbamoyl-tetrasulfide, and 3-octanoylthio-1-propyltriethoxysilane. In this embodiment, a polysulfide-based silane coupling agent is preferable. The polysulfide-based silane coupling agent also functions effectively in crosslinking rubber. Among these, bis(3-triethoxysilylpropyl)tetrasulfide is preferable.

The silane coupling agent can be included in the anti-slip member 10 at a proportion of 1 mass part or more when the content of the silica in the anti-slip member 10 is set to 100 mass parts. The content of the silane coupling agent is preferably 6 mass parts or more, more preferably 7 mass parts or more, based on 100 mass parts of the silica. The content of the silane coupling agent is preferably 20 mass parts or less, more preferably 15 mass parts or less, based on 100 mass parts of the silica.

The anti-slip member 10 can further include a compound having excellent hydrophilicity such as polyethylene glycol. The polyethylene glycol preferably has a mass average molecular weight of 2,000 or more and 5,000 or less. The mass average molecular weight is determined as a polystyrene equivalent by the GPC method. The content of the polyethylene glycol in the anti-slip member 10 is preferably 0.1 mass part or more based on 100 mass parts of the elastomer 11. The content of the polyethylene glycol is more preferably 0.2 mass part or more, still more preferably 0.3 mass part or more. The content of the polyethylene glycol is more preferably 10 mass parts or less, still more preferably 2 mass parts or less.

The anti-slip member 10 can include a plasticizer such as paraffin oil (liquid paraffin). The content of a plasticizer having high hydrophobicity such as paraffin oil is preferably 30 mass parts or less based on 100 mass parts of the elastomer 11.

In addition to the above components, the anti-slip member 10 of this embodiment can further include other optional components such as a vulcanizing agent, a vulcanization accelerator, a crosslinking accelerator, a filler, an antioxidant, or an ultraviolet absorber.

The anti-slip member 10 preferably has a tensile strength of 12 MPa or more, which is measured according to JIS K6251:2017 "Rubber, vulcanized or thermoplastic—Determination of tensile stress-strain properties", in terms of exhibiting the characteristics required for the shoe sole. The anti-slip member 10 preferably has a tensile elongation at break of 350% or more, which is measured according to the above JIS. The anti-slip member 10 preferably has a tear strength of 40 N/mm or more, which is obtained according to JIS K6252-1:2015 "Rubber, vulcanized or thermoplastic-Determination of tear strength—Part 1: Trouser, angle and crescent test pieces". The tear strength can be measured using an angle-shaped test piece (with no cut).

The tensile strength of the anti-slip member 10 is more preferably 15 MPa or more, still more preferably 17 MPa or more. The tensile strength is generally 50 MPa or less. The tensile elongation at break of the anti-slip member 10 is more preferably 400% or more, still more preferably 500% or more. The tensile elongation at break is generally 1000% or less. The tear strength of the anti-slip member 10 is more preferably 50 N/mm or more, still more preferably 60 N/mm or more. The tear strength is generally 120 N/mm or less.

The initial elastic modulus of the anti-slip member 10 is preferably 20 MPa or less, more preferably 12 MPa or less. The initial elastic modulus of the anti-slip member 10 is preferably 1 MPa or more. Similar to the case of the elastomer 11, the initial elastic modulus of the anti-slip member 10 can also be determined from the gradient of the stress-strain curve in a low-strain area in the tensile test according to JIS K6251:2017 (for example, gradient of the stress-strain curve corresponding to a portion between two strain points of $\varepsilon 1=0\%$ and $\varepsilon 2=5\%$).

The anti-slip member 10 of this embodiment can be produced by kneading the above components, that is, the elastomer 11, the water-soluble particles 12, and optionally the silica, the silane coupling agent, the polyethylene glycol, and the like, using any method commonly practiced by those skilled in the art. For example, as the kneading method, a method of kneading the above components, for example, by a A kneading or B kneading step using an open roll, a kneader, or the like can be used.

In addition to the above components, the anti-slip member 10 of this embodiment can further include other optional components such as a vulcanizing agent, a vulcanization accelerator, a crosslinking accelerator, a filler, a plasticizer, an antioxidant, or an ultraviolet absorber.

(Wearable Equipment or Sports Equipment)

The wearable equipment or sports equipment of the present invention includes the anti-slip member 10. The wearable equipment or sports equipment of the present invention is not particularly limited as long as it is equipment to be worn by the user (wearer) or to be attached to the user (wearer) at the time of use, or equipment to be used when the user performs exercise, and can be, for example, shoes, wears, gloves, spectacles, bats, rackets, golf clubs, or the like.

Figure 4:
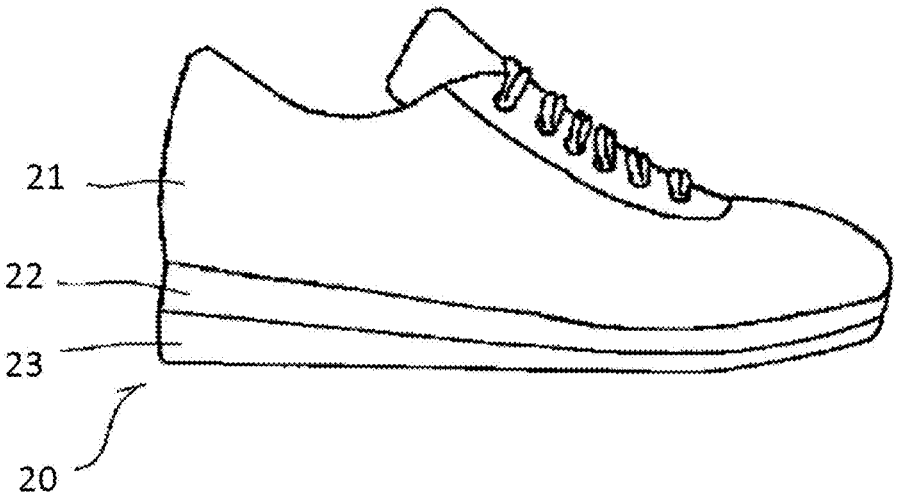
FIG. 4 is a schematic view showing a shoe as the wearable equipment of one embodiment, which has an anti-slip member provided at a ground contact place of a shoe sole.

FIG. 4 is a schematic view showing a shoe 20 as the wearable equipment of one embodiment, which has an anti-slip member 10 provided at a ground contact place of a shoe sole 23. The shoe 20 includes an upper member 21 covering the upper surface of the foot, and a midsole 22 and an outer sole 23 as a shoe sole arranged on the lower side of the upper member 21. Specifically, the shoe 20 is disposed at a ground contact place, and includes the outer sole 23 provided with the anti-slip member 10, and the midsole 22 disposed between the upper member 21 and the outer sole 23. In this embodiment, the shoe 20 includes both the midsole 22 and the outer sole 23, but the shoe 20 does not necessarily include both of them. That is, the shoe 20 can include only the outer sole 23 provided with the anti-slip member 10 as the shoe sole, and can include no midsole 22. In this case, the outer sole 23 can be formed of a foam in order to ensure the cushioning properties required for the midsole.

Figure 5:
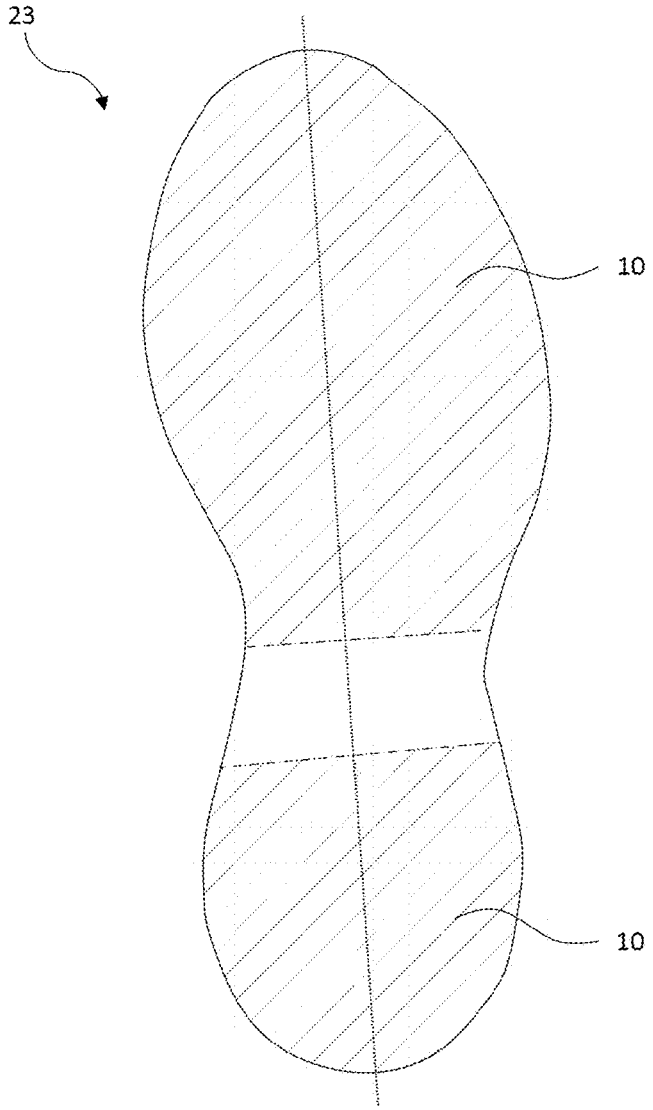
FIG. 5 is a bottom view of the shoe sole of the shoe of FIG. 4 with the anti-slip member provided therein.

FIG. 5 is a bottom view of the shoe sole (outer sole) 23 of the shoe 20 provided with the anti-slip member 10. In the shoe sole 23, as shown in FIG. 5, the anti-slip member 10 can be provided in a region positioned within a range of 0% to 60% of the shoe sole 23 with respect to the longitudinal direction (hereinafter, also referred to as a front region of the shoe sole 23) and in a region within a range of 70% to 100% of the shoe sole 23 with respect to the longitudinal direction (hereinafter, also referred to as a rear region of the shoe sole 23) when the toe-side end is 0% and the heel-side end is 100% of the shoe sole 23 with respect to the longitudinal direction. Preferably, the anti-slip member 10 is provided in a region occupying 5 to 100% of the entire front region of the shoe sole 23, in a region occupying 5 to 100% of the entire rear region of the shoe sole 23, or in the both regions. Herein, the region positioned within the range of 0% to 60% of the shoe sole 23 with respect to the longitudinal direction means a region of the shoe sole 23 located closer to the toe side than a straight line defined by crossing, in a width direction at right angles, a longitudinal straight line passing through the toe-side end and the heel-side end at a point which is a 60% position of the longitudinal straight line. Similarly, the region positioned within the range of 70% to 100% of the shoe sole 23 with respect to the longitudinal direction means a region of the shoe sole 23 located closer to the heel side than a straight line which crosses in the width direction the longitudinal straight line at a 70% position defined in the same manner as above. These regions are designated by their respective areas of the bottom surface of the shoe sole 23 as viewed from its front as in FIG. 5.

Particularly preferably, in the shoe sole 23, the anti-slip member 10 is provided at each of the positions corresponding to the heel, the metatarsophalangeal joints, and the toe of the wearer. In the shoe sole 23, the positions corresponding to the heel, the metatarsophalangeal joints, and toe are likely to exhibit grip performance because they frequently make contact with the ground, and the contact area of each of them is relatively large. Therefore, the wet-grip performance of the shoe 20 can be more effectively increased by arranging the anti-slip member 10 at each of these positions of the shoe sole 23.

However, in the shoe sole 23 of the shoe 20 of the present invention, the position at which the anti-slip member 10 is provided is not particularly limited. For example, the anti-slip member 10 can be provided at at least one of positions of the shoe sole 23 respectively corresponding to the heel, the metatarsophalangeal joints, and the toe, of the wearer, and can be provided at another position different from these positions. The anti-slip member 10 can be provided only in the front region of the shoe sole 23, or can be provided only in the rear region. Further, the anti-slip member 10 can be provided on the entire surface of the shoe sole 23, and the entire shoe sole 23 can be formed of the anti-slip member 10.

In order for the shoe 20 to exhibit high wet-grip performance, it is preferable that the anti-slip member 10 provided in the shoe sole 23 be configured to make contact with the ground through a widest possible area of the anti-slip member 10 when making contact with the ground. Therefore, unlike the conventionally known anti-slip member for the shoe sole, the anti-slip member 10 provided in the shoe sole 23 is preferably free from a large unevenness on its surface, and more preferably has a flat surface.

The shoe 20 of this embodiment is improved in wet-grip performance also to various grounds including grounds with non-paved surfaces by the anti-slip member 10 provided in the shoe sole 23, and among others, wet-grip performance to a road surface paved with concrete, asphalt or the like is particularly increased. In contrast, it should be noted that the shoe 20 of this embodiment, due to its wet-grip-performance enhancing mechanism, is almost unlikely to improve wet-grip performance on a frozen ground or ice.

The anti-slip member 10 of this embodiment is made of an elastomer composition having the water-soluble particles 12 dispersed in the elastomer 11, but the anti-slip member 10 can be formed by combining such an elastomer composition and a known elastic body having no water-soluble particles 12 dispersed in the elastomer 11 but having a general uneven surface for an anti-slip purpose. Further, the anti-slip member 10 can be formed integrally as an elastomer composition including both an internal region with the water-soluble particles 12 dispersed therein and an internal region with no water-soluble particles 12 dispersed therein.

Figure 6:
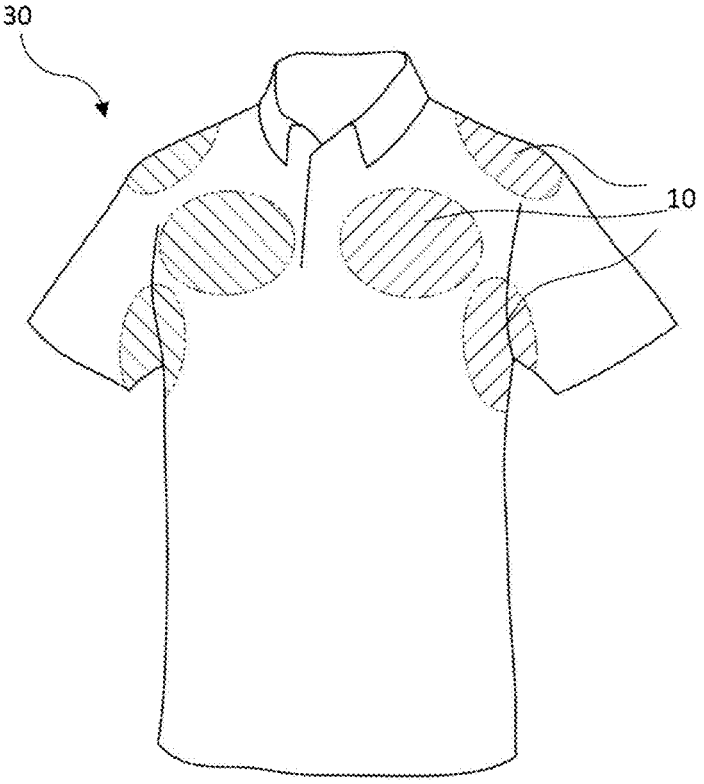
FIG. 6 is a plan view of a rugby wear as the wearable equipment of one embodiment.

FIG. 6 shows a rugby wear 30 as one embodiment of the wearable equipment of the present invention. In the rugby wear 30, as shown in FIG. 6, the anti-slip member 10 can be provided around each of the breast portions of the front body, the shoulder portions, and the armpit portions. The breast portions of the front body and their peripheries, and the armpit portions and their peripheries make contact with a ball as the object when the ball is held by a rugby player during a rugby game. Therefore, the rugby player wearing the rugby wear 30 in which the anti-slip member 10 is provided at each of these portions can enjoy an effect of making it difficult to slip the ball wet with perspiration out of these portions. In addition, the shoulder portions come into contact with the shoulders of a competing player when they form a scrum in the rugby game. Therefore, the rugby player wearing the rugby wear 30 in which the anti-slip member 10 is provided at each of these portions can enjoy an effect of making it difficult to slip on the shoulder portions when forming the scrum.

Figure 7:
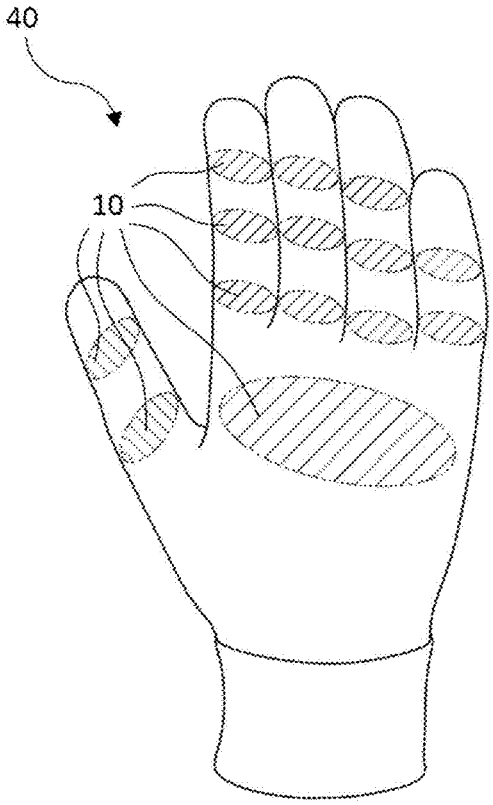
FIG. 7 is a plan view of a glove as the wearable equipment of one embodiment.

FIG. 7 shows a sports glove 40 as one embodiment of the wearable equipment of the present invention. In the sports glove 40, as shown in FIG. 7, the anti-slip member 10 can be provided between portions around the joints of each of the finger bones of the wearer, as well as around the tips of the metacarpal bones. A player wearing the sports glove 40 in which the anti-slip member 10 is provided at each of these portions can enjoy an effect of making it difficult to slip the holding object wet with water or perspiration out of the glove 40.

In one embodiment of the sports equipment of the present invention, the anti-slip member 10 can be provided on a grip of sports equipment such as a bat, a racket or a golf club. Such sports equipment with the anti-slip member 10 provided on the grip has an effect of making it hard for the grip wet with water or perspiration to be slippery, and therefore enabling the user to easily hold the sports equipment stably.

As described above, the anti-slip member for the wearable equipment or sports equipment of this embodiment is composed of the elastomer composition including the elastomer and the water-soluble particles dispersed in the elastomer. Thus, high grip performance can be exhibited even for an object wet with water, and therefore, the wet-grip performance is improved.

The average particle size of the water-soluble particles is preferably 10 μm or more and 100 μm or less. This configuration can more effectively increase the wet-grip performance of the anti-slip member.

It is preferable that the anti-slip member include: the surface layer region having at least one of the water-soluble particles exposed on the surface and the recesses as a result of the disappearance of the water-soluble particles; and the internal region disposed inside the surface layer region, and that the proportion of the water-soluble particles included in the internal region be 1 volume % or more and 5 volume % or less. This configuration can more effectively increase the wet-grip performance of the anti-slip member. It is more preferable that the proportion of the water-soluble particles included in the internal region be 2 volume % or more and 4 volume % or less.

Preferably, the water-soluble particles include the inorganic salt. This configuration allows the water-soluble particles to have an advantage of being hardly subjected to chemical modification by heat at the time of producing the anti-slip member. More preferably, the inorganic salt is sodium chloride.

Preferably, the tensile elastic modulus of the elastomer is 10 MPa or less. This configuration can more efficiently increase the wet-grip performance of the anti-slip member.

Further, since the wearable equipment or sports equipment of this embodiment including the anti-slip member makes it possible to provide the wearable equipment or sports equipment with improved wet-grip performance.

When the wearable equipment is a shoe, the anti-slip member is generally disposed at the ground contact place of the shoe sole. In this case, it is preferable that the anti-slip member be disposed at at least one of positions configured to respectively correspond to a heel, metatarsophalangeal joints, and a toe, of the wearer.

The anti-slip member for the wearable equipment or sports equipment, the wearable equipment, and the sports equipment according to the present invention are not limited to the configuration of the aforementioned embodiment. Further, the anti-slip member for the wearable equipment or sports equipment, the wearable equipment, and the sports equipment according to the present invention are not limited to those having the aforementioned operational effects. Various modifications can be made to the anti-slip member for the wearable equipment or sports equipment, the wearable equipment, and the sports equipment according to the present invention without departing from the gist of the present invention.

Although detailed description beyond the above will not be repeated here, conventionally known technical matters on an anti-slip member for wearable equipment or sports equipment, wearable equipment, and sports equipment may be optionally employed in the present invention even if the matters are not directly described in the above.

EXAMPLES

Hereinafter, the present invention will be elucidated by way of specific examples and comparative examples of the present invention. However, the present invention is not limited to the following examples.

(Preliminary Study)

First, to examine how a recess formed on the surface of the anti-slip member affects wet-grip performance, a rubber with a recess formed on its surface and a rubber with no recess formed thereon were subjected to a friction test with a flat glass plate not wet with water and a flat glass plate wet with water.

Rubber

The rubbers used for the friction test were both silicone rubbers each having a hemispherical shape with a radius of curvature of 7.6 mm. One of the rubbers was a rubber SP1 of which the peak has a smooth flat surface with no recess or the like while the other one was a rubber SP2 of which the peak, which is to be in contact with the glass plate, has a recess of about 100 $\mu m^3$. These rubbers had fluorescent particles kneaded therein to facilitate observation of their contact with the plate during the friction test.

Friction Test

Figure 8:
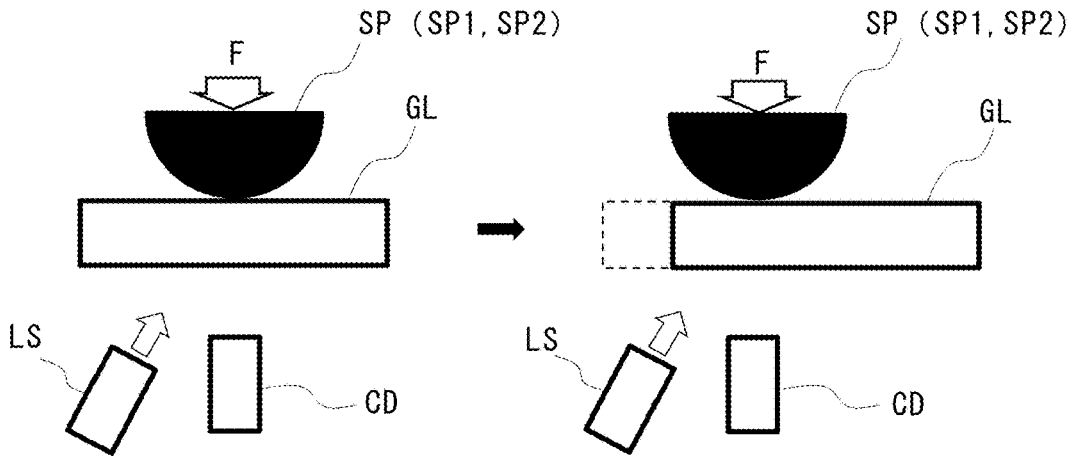
FIG. 8 is a schematic view showing an apparatus for observing a contact portion and capturing an image thereof between a rubber and a flat glass plate when a friction test is performed in a preliminary study of Examples.

As shown on the left side of FIG. 8, each of the rubbers SP1 and SP2 was placed on a flat glass plate GL that was dry (under a non-lubrication condition) or that was wet with water (under a water lubrication condition), so as to bring their peaks into contact with the surface of the flat glass plate GL. Thereafter, as shown on the right side of FIG. 8, the flat glass plate GL was caused to slide by 5.0 mm in a direction parallel to its surface on the rubber SP1, SP2 with its peak subjected to a vertical load F=0.0981 N and at a sliding velocity of 0.10 mm/s.

During this step, a continuous observation was performed for a true contact part between the rubber SP1, SP2 and the flat glass plate GL under each of the non-lubrication condition and the water lubrication condition using an apparatus shown in FIG. 8, and an image of the true contact part was captured after the flat glass plate was caused to slide by 5.0 mm. This apparatus includes a light source LS for illuminating the true contact part, and a CCD device CD for capturing an image of the true contact part. The true contact part was observed and its image was captured by a combination of the total reflection method and the light interference method.

Figure 9:
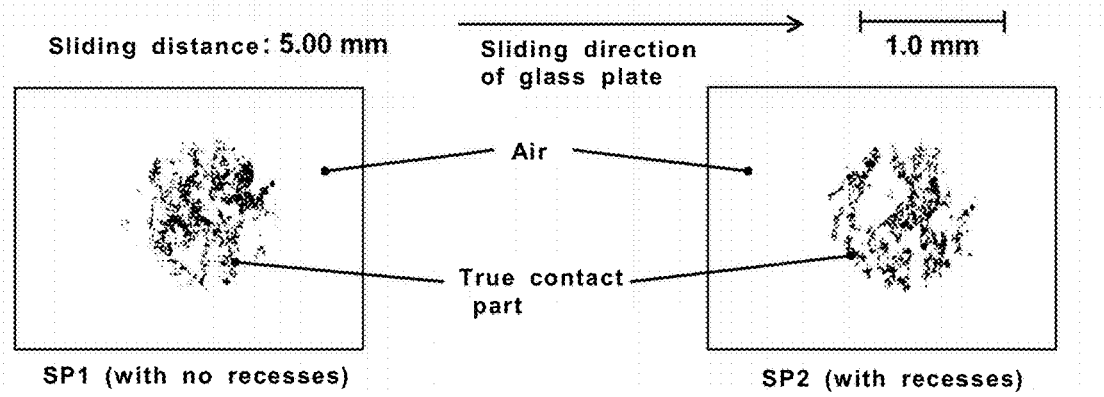
FIG. 9 shows photographs each of a contact portion of the flat glass plate with a rubber after the flat glass plate is caused to slip by 5 mm on the rubber having a peak with a flat smooth surface, which is to be in contact with the glass plate, in the preliminary study of Examples.
Figure 10:
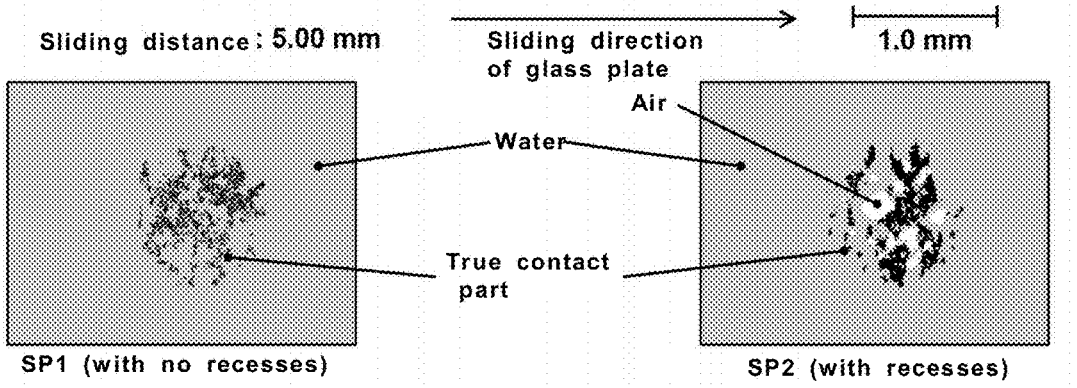
FIG. 10 shows photographs each of a contact portion of the flat glass plate with a rubber after the flat glass plate is caused to slip by 5 mm on the rubber having a peak with a recess of about 100 $\mu m^3$, which is to be in contact with the glass plate, in the preliminary study of Examples.
Figure 11:
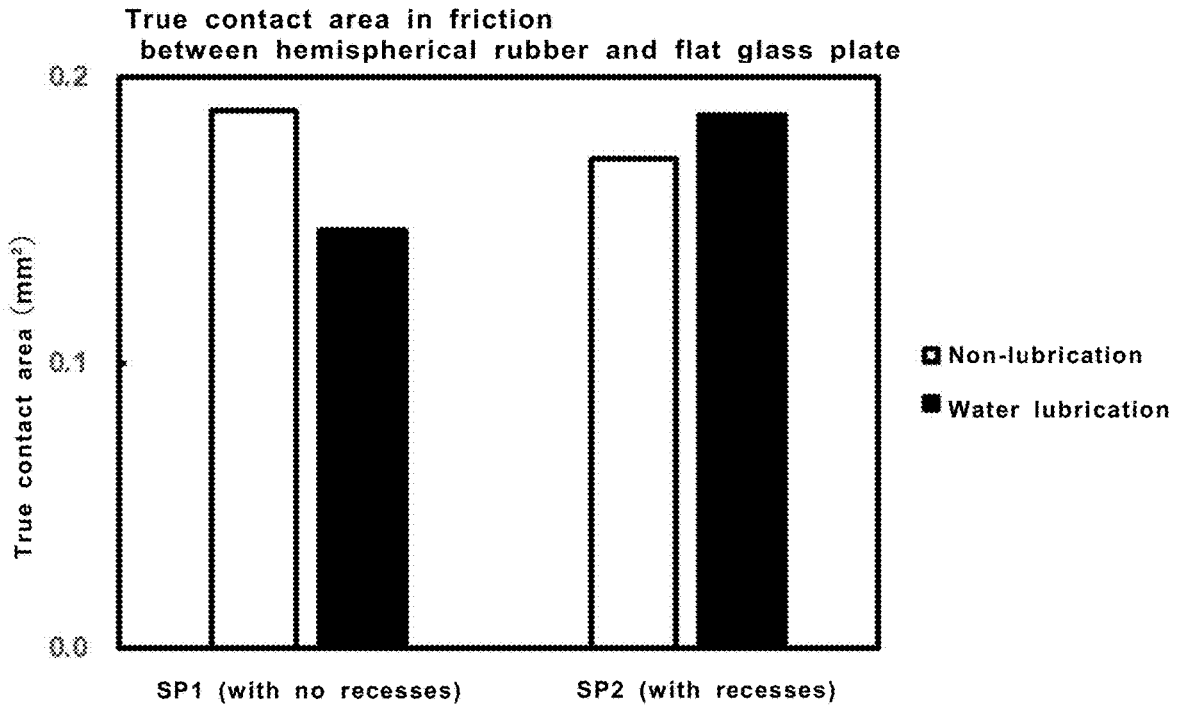
FIG. 11 is a graph showing areas each of a contact portion of the flat plate glass with the rubber after the flat glass plate is caused to slip by 5 mm on the rubber in the preliminary study of Examples.

FIG. 9 and FIG. 10 show photographs of the true contact parts captured under the non-lubrication condition and the water lubrication condition, respectively. In each of FIG. 9 and FIG. 10, a region in black represents the true contact part, and a white region represents a portion of the flat glass plate GL not in contact with the rubber SP1, SP2. In FIG. 10, a gray region represents a portion of the flat glass plate GL in contact with water (i.e., wet), and a white region represents a portion of the flat glass plate GL in contact with neither the rubber SP1, SP2 nor water (i.e., in which air was present). Although not shown, the phenomenon was observed under the water lubrication condition that, in the true contact part between the rubber SP2 and the flat glass plate GL, air was present only in a portion with the recess before the flat glass plate GL was caused to slide, and bubbles spread across a wide range of the true contact part when the flat glass plate GL was caused to slide. The areas (true contact areas) of the black regions (true contact parts) derived from the photographs of FIG. 9 and FIG. 10 are obtained and shown as a graph in FIG. 11.

Figure 12:
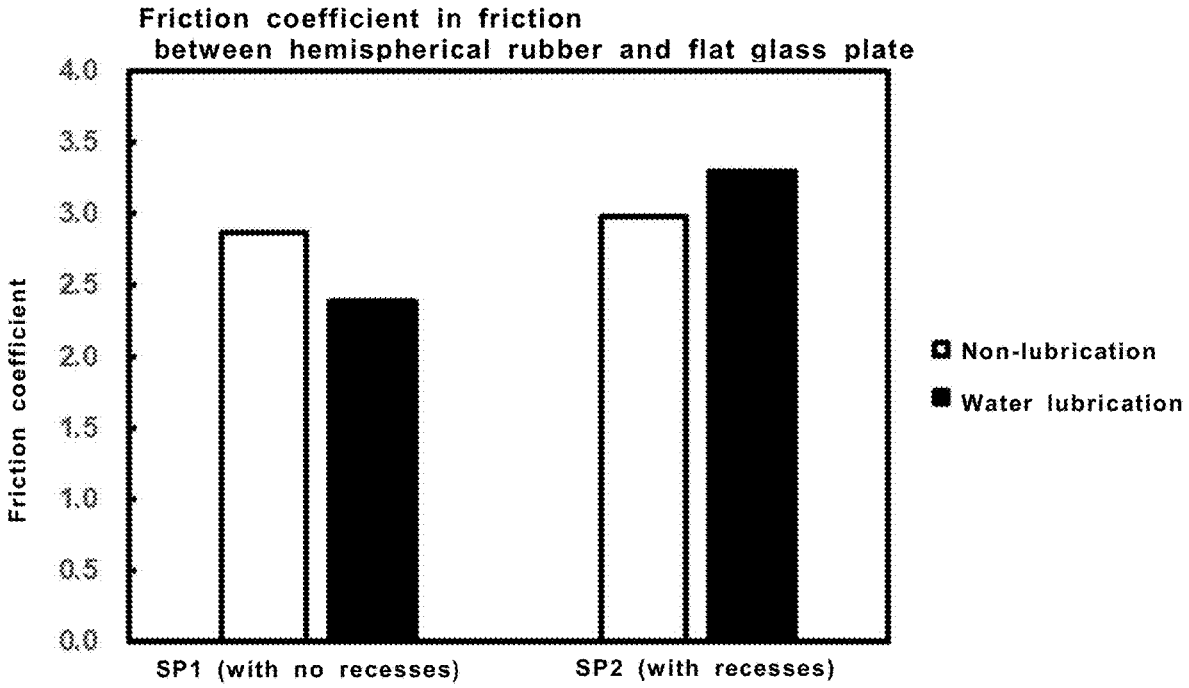
FIG. 12 is a graph showing static friction coefficients between the flat glass plate and the rubber after the flat glass plate is caused to slip by 5 mm on the rubber in the preliminary study of Examples.

Further, the static friction coefficient between the rubber SP1, SP2 and the flat glass plate GL was measured after the flat glass plate GL was caused to slide by 5.0 mm. FIG. 12 shows the measured static friction coefficients.

As understood from FIGS. 9 to 12, under the non-lubrication condition, the true contact area between the rubber SP2 and the flat glass plate GL after the flat glass plate GL was caused to slide by 5.0 mm was slightly smaller than the true contact area with the rubber SP1 due to the recess formed on the surface of the rubber SP2, but the friction coefficient therebetween was substantially the same as that of the rubber SP1. Thus, it can be understood that the grip performance under the non-lubrication condition is hardly affected by the recess formed on the surface. Under the water lubrication condition, in contrast, it can be understood that the true contact area between the rubber SP2 and the flat glass plate GL after the flat glass plate GL was caused to slide by 5.0 mm was larger by about 38% than the true contact area with the rubber SP1, and the friction coefficient therebetween was also larger by about 27%. In addition, it can be understood that the rubber SP2 with the recess formed on the surface had a larger friction coefficient under the water lubrication condition than that under the non-lubrication condition. It is understood from the results that the wet-grip performance of a rubber with a recess formed on its surface increases so significantly under the water lubrication condition that it exceeds the wet-grip performance thereof under the non-lubrication condition.

(Study of Elastomer Composition)

Next, to examine the wet-grip performance, durability, or the like of various elastomer compositions forming the anti-slip member according to the present invention, various tests shown below were performed for various elastomer compositions according to examples and comparative examples below.

The following materials were prepared as materials of rubbers to be mixed into the elastomer compositions:

- IR: Isoprene rubber (high-cis type, Mooney viscosity: approx. 82)
- $SiO_2$: Precipitated silica
- CA: Silane coupling agent (bis(3-triethoxysilylpropyl) tetrasulfide)
- PEG: Polyethylene glycol (mass-average molecular weight: approx. 3000, melting point: approx. 60° C.)
- PO: Liquid paraffin (kinematic viscosity: approx. 40 $mm^2/s$, molecular weight: 430)
- St: Stearic acid
- ZnO: Activated zinc oxide
- AO: 2,6-di-tert-butyl-4-methylphenol
- OZONOC: Colorless, non-contaminating ozone cracking inhibitor
- OA: Organic amine vulcanization accelerator These materials were mixed and kneaded three separate times sequentially at the respective mixing ratios (mass ratios) shown in Table 1 below to prepare rubbers (a) to (e). Specifically, each of various IRs, which are primary kneading materials of the rubber raw material shown in Table 1 below, was kneaded under the condition of 80 to 130° C. for a minute using a kneader (apparatus name: DS3-10MWB, manufactured by Nihon Spindle Manufacturing Co., Ltd.) to obtain a primary kneaded material. The primary kneaded material thus obtained was mixed with $SiO_2$, PO, CA, St, and ZnO, which are secondary kneading materials, at the respective mixing ratios (mass ratios) shown in Table 1 below, and the mixture was kneaded under the condition of 80 to 130° C. for 5 minutes using a kneader (apparatus name: DS3-10MWB, manufactured by Nihon Spindle Manufacturing Co., Ltd.) to obtain a secondary kneaded material. The secondary kneaded material thus obtained was mixed with OA, PEG, and AO, which are tertiary kneading materials, at the respective mixing ratios (mass ratios) shown in Table 1 below, and the mixture was kneaded under the condition of 25 to 60° C. for 10 minutes using an open roll (apparatus name: KD-M2-8, manufactured by KNEADER MACHINERY CO., LTD.) to obtain each of the rubbers (a) to (e).

TABLE 1

| | Material | (a) | (b) | (c) | (d) | (e) |
|---|---|---|---|---|---|---|
| Primary | IR | 100 | 100 | 100 | 100 | 100 |
| Secondary | $SiO_2$ | 44 | 51 | 60 | 69 | 80 |
| | PO | 20 | 20 | 20 | 20 | 20 |
| | CA | 4.4 | 5.1 | 6.0 | 6.9 | 8.0 |
| | St | 2 | 2 | 2 | 2 | 2 |
| | ZnO | 5 | 5 | 5 | 5 | 5 |
| Tertiary | OA | 1 | 1 | 1 | 1 | 1 |
| | PEG | 1 | 1 | 1 | 1 | 1 |
| | OZONOC | 0.5 | 0.5 | 0.5 | 0.5 | 0.5 |
| | AO | 1 | 1 | 1 | 1 | 1 |
| | Total | 178.9 | 186.6 | 196.5 | 206.4 | 218.5 |

As the water-soluble particles to be mixed into each of the elastomer compositions, sodium chloride (NaCl) particles respectively having average particle sizes of 5 μm 10 μm 20 μm 45 μm and 300 μm were prepared.

In addition to the rubber and sodium chloride particles described above, the following materials were prepared as other materials to be mixed into each of the elastomer compositions:

TiO2: Titanic oxide

S: Sulfur

DM: di-2-benzothiazolyl disulfide

TS: Tetramethylthiuram monosulfide

Comparative Examples 1 to 5 and Examples 1 to 13

Each of the rubbers prepared as described above, the sodium chloride particles, and the above other materials were mixed together at the respective mixing ratios (mass ratios) shown in Table 2 below, and each of the mixtures was kneaded under the condition of 25 to 60° C. for 10 minutes using an open roll (apparatus name: KD-M2-8, manufactured by KNEADER MACHINERY CO., LTD.) to obtain each of the elastomer compositions.

TABLE 2

| | C. Ex. 1 | C. Ex. 2 | C. Ex. 3 | C. Ex. 4 | C. Ex. 5 | Ex. 1 |
|---|---|---|---|---|---|---|
| (a) | 178.90 | | | | | |
| (b) | | 186.60 | | | | |
| (c) | | | 196.50 | | | 196.50 |
| (d) | | | | 206.60 | | |
| (e) | | | | | 218.50 | |
| S | 2.0 | 2.0 | 2.0 | 2.0 | 2.0 | 2.0 |
| DM | 1.0 | 1.0 | 1.0 | 1.0 | 1.0 | 1.0 |
| TS | 0.1 | 0.1 | 0.1 | 0.1 | 0.1 | 0.1 |
| NaCl 5 μm | | | | | | |
| NaCl 10 μm | | | | | | 4.05 |
| NaCl 20 μm | | | | | | |
| NaCl 45 μm | | | | | | |
| NaCl 300 μm | | | | | | |
| $TiO_2$ | 35.02 | 36.11 | 37.22 | 38.29 | 39.67 | 37.62 |
| Total | 182.00 | 189.70 | 199.60 | 209.50 | 221.60 | 203.66 |

| | Ex. 2 | Ex. 3 | Ex. 4 | Ex. 5 | Ex. 6 | Ex. 7 |
|---|---|---|---|---|---|---|
| (a) | | | | | | |
| (b) | | | | | | |
| (c) | 196.50 | 196.50 | 196.50 | 196.50 | 196.50 | 196.50 |
| (d) | | | | | | |
| (e) | | | | | | |
| S | 2.0 | 2.0 | 2.0 | 2.0 | 2.0 | 2.0 |
| DM | 1.0 | 1.0 | 1.0 | 1.0 | 1.0 | 1.0 |
| TS | 0.1 | 0.1 | 0.1 | 0.1 | 0.1 | 0.1 |
| NaCl 5 μm | | | | | 12.45 | |
| NaCl 10 μm | 8.21 | 12.45 | 16.79 | 21.22 | | |
| NaCl 20 μm | | | | | | 12.45 |
| NaCl 45 μm | | | | | | |
| NaCl 300 μm | | | | | | |
| $TiO_2$ | 38.02 | 38.43 | 38.86 | 39.29 | 38.43 | 38.43 |
| Total | 207.81 | 212.05 | 216.39 | 220.82 | 212.05 | 212.05 |

| | Ex. 8 | Ex. 9 | Ex. 10 | Ex. 11 | Ex. 12 | Ex. 13 |
|---|---|---|---|---|---|---|
| (a) | | | 178.90 | | | |
| (b) | | | | 186.60 | | |
| (c) | 196.50 | 196.50 | | | | |
| (d) | | | | | 206.60 | |
| (e) | | | | | | 218.50 |
| S | 2.0 | 2.0 | 2.0 | 2.0 | 2.0 | 2.0 |
| DM | 1.0 | 1.0 | 1.0 | 1.0 | 1.0 | 1.0 |
| TS | 0.1 | 0.1 | 0.1 | 0.1 | 0.1 | 0.1 |
| NaCl 5 μm | | | | | | |
| NaCl 10 μm | | | 11.72 | 12.08 | 12.81 | 13.27 |
| NaCl 20 μm | | | | | | |
| NaCl 45 μm | 12.45 | | | | | |
| NaCl 300 μm | | 12.45 | | | | |
| $TiO_2$ | 38.43 | 38.43 | 37.22 | 38.29 | 39.67 | 38.43 |
| Total | 212.05 | 212.05 | 193.72 | 201.78 | 222.31 | 234.87 |

Measurement of Hardness

The hardness of each of the elastomeric compositions of Comparative Examples 1 to 5 and Examples 1 to 13 was measured using "Asker Rubber Hardness Meter Type A" manufactured by Kobunshi Keiki Co., Ltd., as a type A durometer according to JIS K 6253-3:2012. The results are shown in Table 3 below. As can be seen from Table 3, the rubbers (a), (b), (c), (d), and (e) of Comparative Examples 1 to 5 correspond to rubbers having hardness values of 55, 60, 65, 70, and 75, respectively.

Measurement of Initial Elastic Modulus, Tensile Strength, and Elongation at Break Each of the elastomer compositions of Comparative Examples 1 to 5 and Examples 1 to 13 was cut into a flat plate having a thickness of 4 mm, followed by cutting the flat plate using a dumbbell-shaped type-2 punching die based on JIS K 6251:2017 to obtain a dumbbell-shaped test piece for each of the resin composites. Each of the test pieces was subjected to a tensile test based on JIS K 6251:2017, using an autograph precision universal tester (product name "AG-50kNIS MS" manufactured by Shimadzu Corporation) at 23° C. and at a crosshead speed of 500 mm/min, to thereby measure the tensile strength and the elongation at break of the test piece. Further, the initial elastic modulus of each of the test pieces was measured based on the gradient of the stress/strain curve corresponding to a portion between two strain points of $\varepsilon 1=0\%$ and $\varepsilon 2=5\%$ in the tensile test. The results are shown in Table 3 below.

Measurement of Tear Strength

Each of the elastomer compositions of Comparative Examples 1 to 5 and Examples 1 to 13 was heated at 160° C. for 8 to 12 minutes using a flat plate mold having a thickness of 2 mm to obtain a flat plate-shaped test piece having a thickness of 2 mm. Each of the test pieces was formed into a standard shape using a punching die, and subjected to a tear test based on JIS K 6252:2007 to thereby measure the tensile strength of each of the test pieces. The results are shown in Table 3 below.

Measurement of Abrasion Resistance

A cylindrically-shaped mold having a diameter of 16.0 mm and a thickness of 12 mm was used to obtain a cylindrically-shaped test piece composed of each of the elastomer compositions of Comparative Examples 1 to 5 and Examples 1 to 13. Each of the test pieces was subjected to a DIN abrasion test based on JIS K 6264-2:2005 to thereby measure the abrasion volume of each of the test pieces. The results are shown in Table 3 below.

Friction Test

Figure 13:
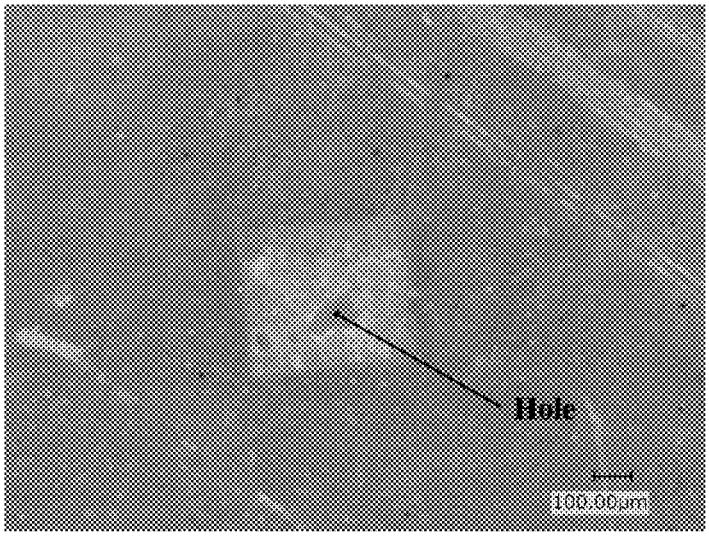
FIG. 13 is a photograph of a part of a surface of a test piece after sodium chloride exposed on the surface of the test piece is eluted in the friction test of Examples.

Each of the elastomer compositions of Comparative Examples 1 to 5 and Examples 1 to 13 was introduced into a molding die having a flat plate shape, and pressed at 160° C. for 8 to 12 minutes (i.e., predetermined appropriate vulcanization time+2 minutes) using a device (name: Ram diameter of 12" 150 tons (manufactured by Nimei Koki Co., Ltd.)), thereby obtaining a test piece molded into a flat plate shape having a thickness of 2 mm. Each of the obtained test pieces was ultrasonically cleaned with ion-exchanged water three times to thereby remove sodium chloride particles exposed on the surface of each of the test pieces of Examples 1 to 13. FIG. 13 shows a photograph of a part of the surface of the test piece of Example 5 from which the sodium chloride particles exposed on the surface have been removed. It can be confirmed in FIG. 13 that the sodium chloride particles exposed on the surface of the test piece have been eluted to thereby form recesses each having a diameter of about 100 μm on the surface.

Each of the test pieces was made wet with water, and an alumina ball was caused to slide on the test piece to thereby measure the static friction coefficient and the dynamic friction coefficient under the water lubrication condition. Specifically, under the atmospheric temperature of 24° C. and the relative humidity of 75% RH, the surface of the test piece molded into a flat shape was made wet with water, and the alumina ball having a diameter of 9.5 mm was disposed on the surface of the test piece wet with water so as to be in contact with the surface of the test piece. Thereafter, the alumina ball was caused to slide on the surface of the test piece at a vertical load of 4.91 N and a sliding speed of 10.0 mm/s to measure the static friction coefficient and the dynamic friction coefficient at that time. The results are shown in Table 3 below.

TABLE 3

| | Rubber type | NaCl diameter in um | NaCl content in vol % | Hardness in HA | Tensile strength in MPa | Elongation at break in % | Initial elastic modulus in MPa | Tear strength in N/mm | Abrasion volume in $mm^3$ | Static friction coefficient | Dynamic friction coefficient |
|---|---|---|---|---|---|---|---|---|---|---|---|
| C. Ex. 1 | (a) | | 0 | 55 | 14.0 | 504.8 | 5.6 | 75.9 | 213.6 | 0.86 | 0.77 |
| C. Ex. 2 | (b) | | 0 | 60 | 14.4 | 458.1 | 8.7 | 77.3 | 197.0 | 0.76 | 0.75 |
| C. Ex. 3 | (c) | | 0 | 65 | 17.9 | 545.4 | 9.9 | 78.0 | 187.9 | 0.80 | 0.74 |
| C. Ex. 4 | (d) | | 0 | 70 | 19.9 | 594.6 | 12.5 | 85.5 | 183.5 | 0.72 | 0.63 |
| C. Ex. 5 | (e) | | 0 | 75 | 16.7 | 495.2 | 15.4 | 72.3 | 167.8 | 0.72 | 0.65 |
| C. Ex. 3 | (c) | | 0 | 65 | 17.9 | 545.4 | 9.9 | 78.0 | 187.9 | 0.80 | 0.74 |
| Ex. 1 | (c) | 10 | 1 | 65 | 17.0 | 576.9 | 10.9 | 75.7 | 200.8 | 0.88 | 0.84 |
| Ex. 2 | (c) | 10 | 2 | 65 | 18.1 | 590.6 | 10.2 | 74.5 | 203.8 | 1.03 | 0.97 |
| Ex. 3 | (c) | 10 | 3 | 65 | 16.8 | 581.3 | 10.8 | 77.0 | 206.4 | 1.13 | 1.09 |
| Ex. 4 | (c) | 10 | 4 | 65 | 16.0 | 547.5 | 10.8 | 71.7 | 217.3 | 1.09 | 1.04 |
| Ex. 5 | (c) | 10 | 5 | 65 | 14.0 | 504.8 | 11.3 | 67.9 | 232.7 | 0.94 | 0.91 |
| Ex. 6 | (c) | 5 | 3 | 65 | 17.0 | 573.0 | 11.0 | 78.1 | 213.1 | 1.07 | 0.95 |
| Ex. 3 | (c) | 10 | 3 | 65 | 16.8 | 581.3 | 10.8 | 77.0 | 206.4 | 1.13 | 1.09 |
| Ex. 7 | (c) | 20 | 3 | 65 | 17.0 | 577.4 | 10.8 | 72.6 | 208.4 | 1.14 | 1.12 |
| Ex. 8 | (c) | 45 | 3 | 65 | 17.3 | 571.9 | 10.7 | 73.1 | 193.3 | 1.15 | 1.10 |
| Ex. 9 | (c) | 300 | 3 | 65 | 14.3 | 516.0 | 10.1 | 70.2 | 193.9 | 1.03 | 0.92 |
| Ex. 10 | (a) | 10 | 3 | 55 | 18.3 | 644.0 | 6.4 | 77.2 | 199.8 | 1.25 | 1.19 |
| Ex. 11 | (b) | 10 | 3 | 60 | 16.5 | 578.1 | 8.9 | 71.3 | 198.1 | 1.19 | 1.15 |
| Ex. 3 | (c) | 10 | 3 | 65 | 16.8 | 581.3 | 10.8 | 77.0 | 206.4 | 1.13 | 1.09 |
| Ex. 12 | (d) | 10 | 3 | 70 | 16.5 | 545.6 | 13.2 | 70.9 | 217.6 | 0.97 | 0.94 |
| Ex. 13 | (e) | 10 | 3 | 75 | 14.4 | 458.1 | 17.4 | 75.5 | 211.2 | 0.84 | 0.79 |

Evaluation of Friction Test

The evaluation for the above friction tests will be described below using the results shown in Table 3 and with reference to FIGS. 14 to 23 based on the results.

Effect Resulting from Sodium Chloride Particles

As is evident from the results shown in Table 3, each of the elastomer compositions of Examples 1 to 13 including the sodium chloride particles as the water-soluble particles are more excellent in the static friction coefficient and the dynamic friction coefficient under the water lubrication condition than the elastomer compositions of Comparative Examples 1 to 5 each including rubber only with no sodium chloride particles.

Effect by the Content of Sodium Chloride Particles

Figure 14:
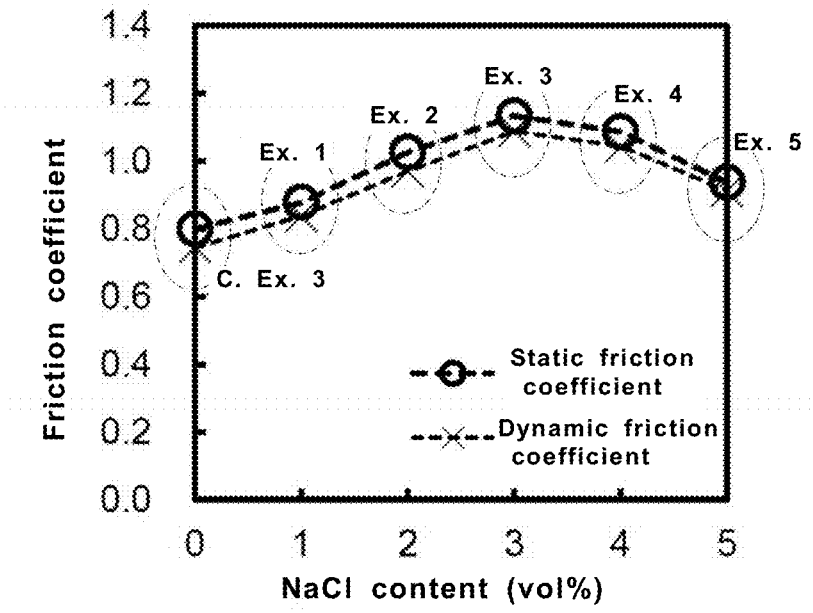
FIG. 14 is a graph of static friction coefficients and dynamic friction coefficients of elastomer compositions in Examples and Comparative Examples.

FIG. 14 is a view showing a relationship between the content of sodium chloride particles and the static friction coefficient and the dynamic friction coefficient in the friction test for each of the elastomer compositions of Comparative Example 3 and Examples 1 to 5, which include the rubber (c). As can be seen from FIG. 14, the static friction coefficient and the dynamic friction coefficient under the water lubrication condition increase as the content of the sodium chloride particles increases to 3 volume %, while the content of the sodium chloride particles decreases when the content of the sodium chloride particles exceeds 3 volume %. That is, in the examples, Example 3 in which the content of the sodium chloride particles is 3 volume % has the elastomer composition having the highest static friction coefficient and the highest dynamic friction coefficient under the water lubrication condition.

Figure 15:
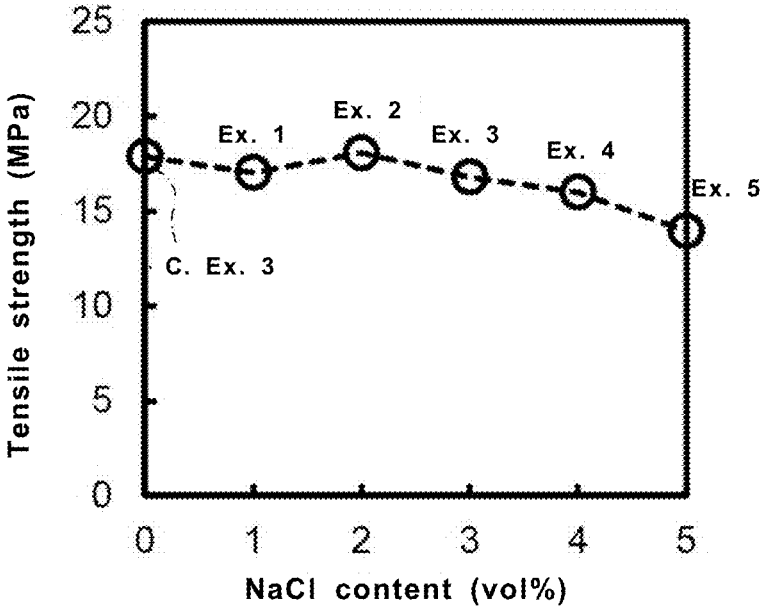
FIG. 15 is a graph of tensile strengths of the elastomer compositions in Examples and Comparative Examples.
Figure 16:
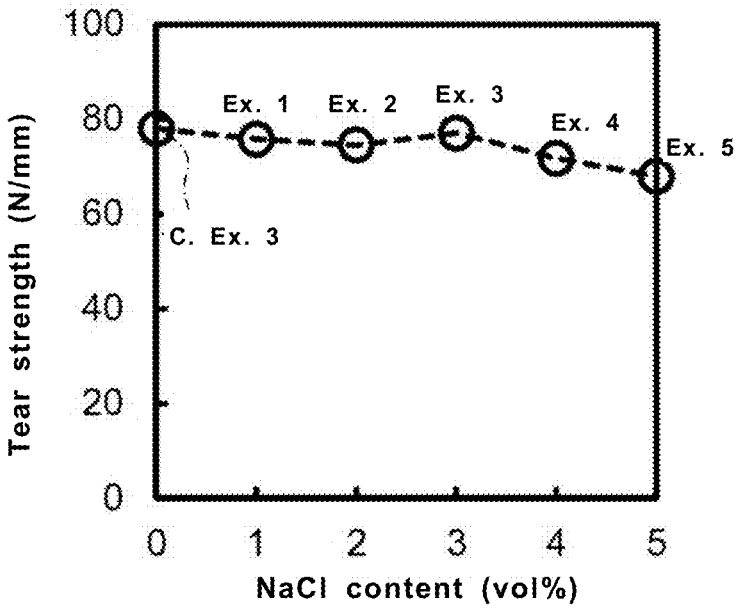
FIG. 16 is a graph of tear strengths of the elastomer compositions in Examples and Comparative Examples.
Figure 17:
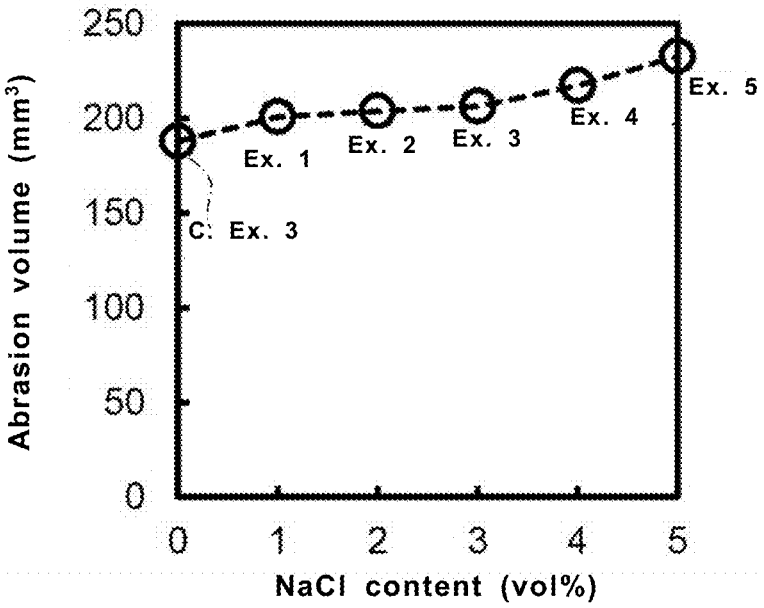
FIG. 17 is a graph of wear volumes of the elastomer compositions in Examples and Comparative Examples.

FIGS. 15 to 17 are views each showing the relationship between the amount of the sodium chloride particles added and each of the tensile strength, the tear strength, and the abrasion volume in the above abrasion test, for each of the elastomer compositions of Comparative Example 3 and Examples 1 to 5. As can be seen from FIG. 15 and FIG. 16, the tensile strength and the tear strength of each of the elastomer compositions generally decrease as the content of the sodium chloride particles increases. Further, as can be seen from FIG. 17, the abrasion volume increases and thereby the abrasion resistance of each of the elastomer compositions decreases as the content of the sodium chloride particles increases.

Effect by the Particle Size of Sodium Chloride Particles

Figure 18:
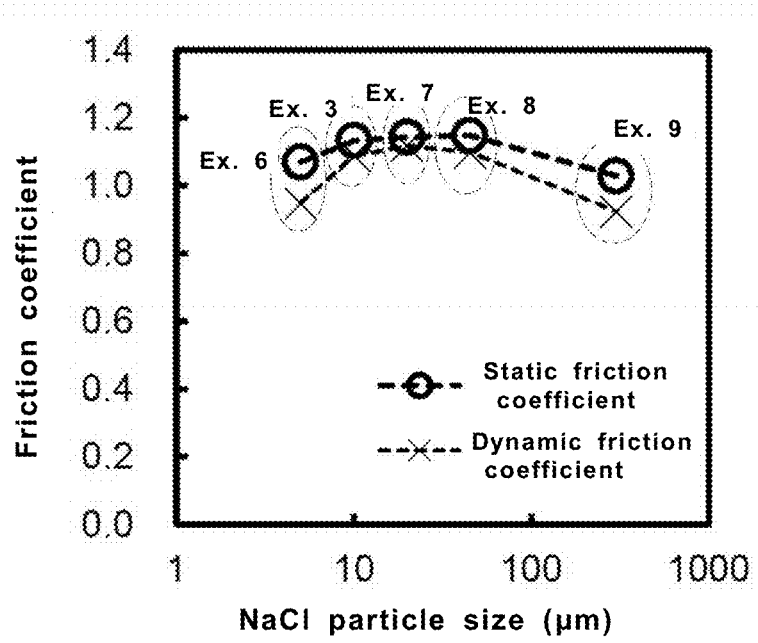
FIG. 18 is a graph of static friction coefficients and dynamic friction coefficients of the elastomer compositions in Examples.

FIG. 18 is a view showing the relationship between the particle size of the sodium chloride particles and the static friction coefficient and the dynamic friction coefficient in the above friction test for each of the elastomer compositions of Examples 3 and 6 to 9. As can be seen from FIG. 18, the static friction coefficient and the dynamic friction coefficient under the water lubrication condition are relatively high when the particle size of the sodium chloride particles falls within 10 to 45 μm.

Figure 19:
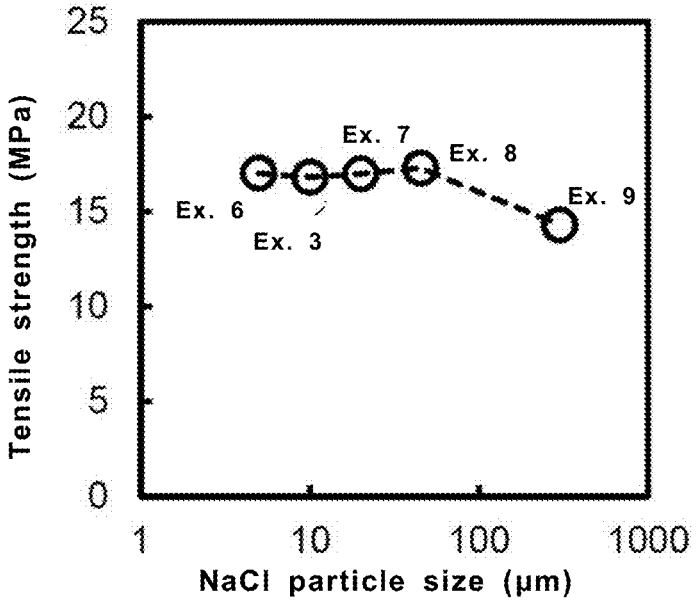
FIG. 19 is a graph of tensile strengths of the elastomer compositions in Examples.
Figure 20:
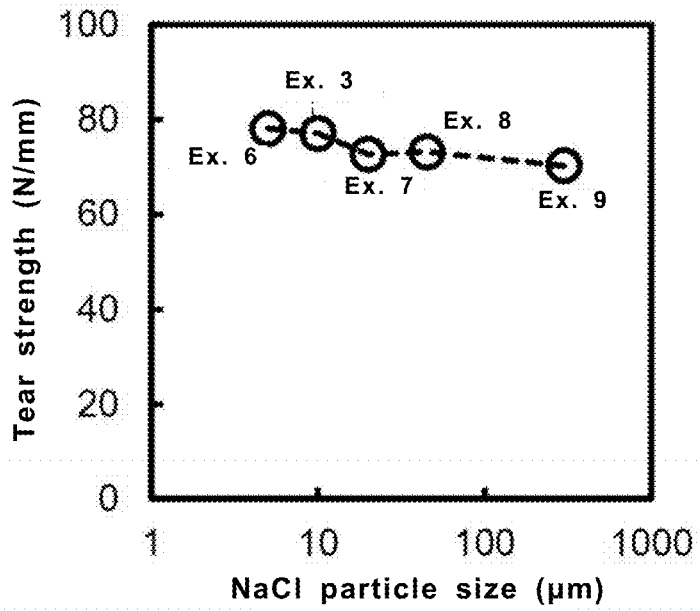
FIG. 20 is a graph of tear strengths of the elastomer compositions in Examples.
Figure 21:
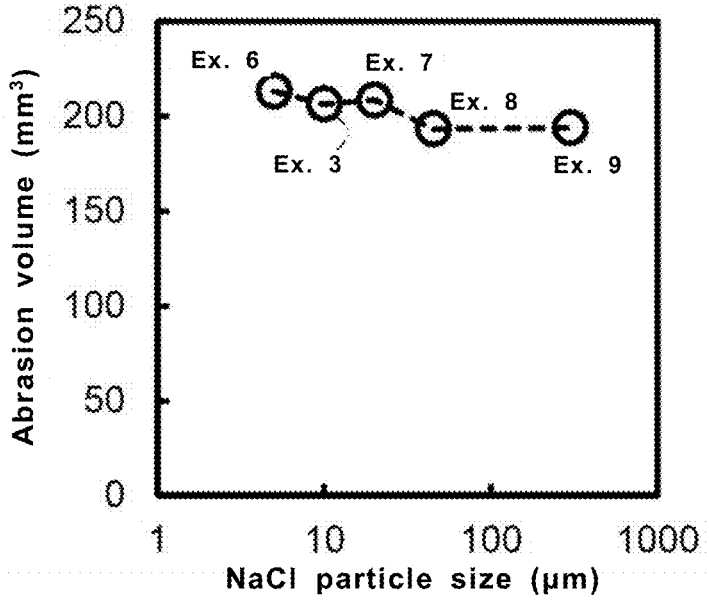
FIG. 21 is a graph of wear volumes of the elastomer compositions in Examples.

FIGS. 19 to 21 are views each showing the relationship between the particle size of the sodium chloride particles and each of the tensile strength, the tear strength, and the abrasion volume in the above abrasion test, for each of the elastomer compositions of Example 3 and 6 to 9. As can be seen from FIG. 19 and FIG. 20, the tensile strength and the tear strength of each of the elastomer compositions generally decrease as the particle size of the sodium chloride particles increases. As can be seen from FIG. 21, in contrast, the abrasion volume decreases and thereby the abrasion resistance of the elastomer composition increases as the content of the sodium chloride particles increases.

Figure 22:
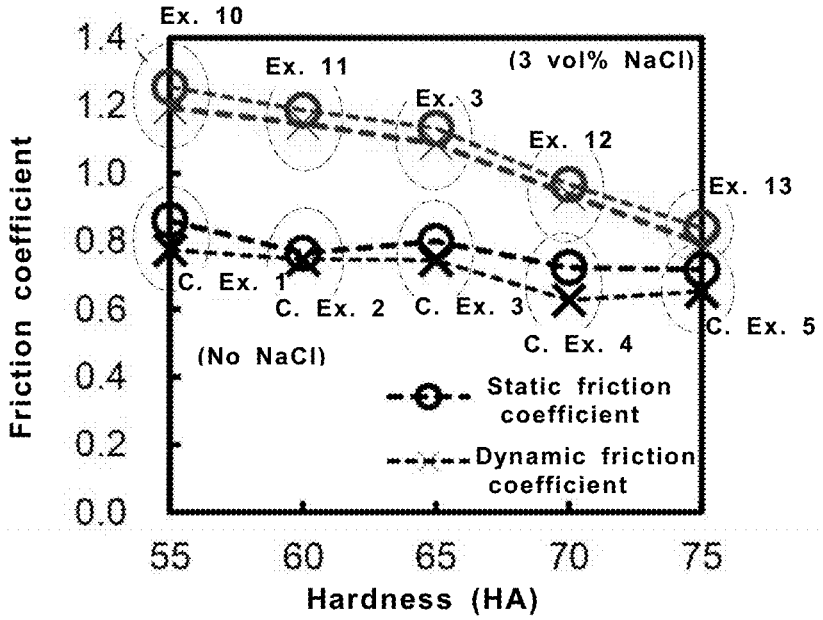
FIG. 22 is a graph of static friction coefficients and dynamic friction coefficients of the elastomer compositions in Examples and Comparative Examples.
Figure 23:
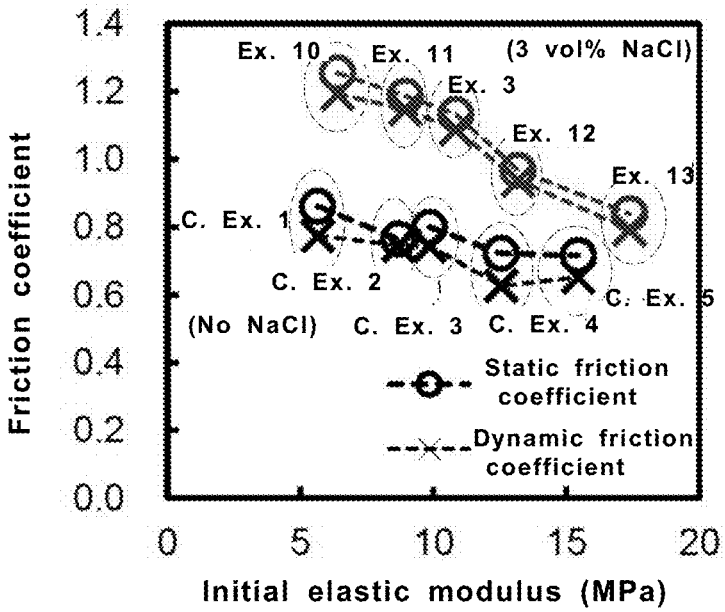
FIG. 23 is a graph of static friction coefficients and dynamic friction coefficients of the elastomer compositions in Examples and Comparative Examples.

Effect of Sodium Chloride Particles on Hardness and Elastic Modulus of Elastomer Compositions FIGS. 22 and 23 are views each showing the relationship of the static friction coefficient and the dynamic friction coefficient in the above friction test to each of the hardness and the elastic modulus, for each of the elastomer compositions of Comparative Examples 1 to 5 and Examples 3 and 10 to 13. As can be seen from FIG. 22 and FIG. 23, the lower the hardness or the elastic modulus of the rubber, the more remarkably the static friction coefficient and the dynamic friction coefficient under the water lubrication condition increase due to the inclusion of the sodium chloride particles. In particular, the sodium chloride particles exert the great effect of increasing the wet-grip performance when the hardness is 65 or less or the elastic modulus is 10 MPa or less.

As described above, it can be seen that each of the elastomer compositions of Examples 1 to 13 in which the sodium chloride particles as the water-soluble particles are dispersed in the rubber as the elastomer has a significantly increased friction coefficient in the state wet with water, that is, significantly increased wet-grip performance, as compared with each of the elastomer compositions of Comparative Examples 1 to 5 including no sodium chloride particles. In particular, it can be seen that each of the elastomer compositions of Examples 3, 7, 8, 10, and 11 in which the rubber having a low hardness and a low elastic modulus includes 3 volume % of the sodium chloride particles having an average particle size of 10 to 45 μm can more effectively increase wet-grip performance while relatively suppressing the mechanical performance characteristics from being degraded by the sodium chloride particles.

REFERENCE SIGNS LIST

10: Elastomer composition
11: Elastomer
12: Water-soluble particles

The invention claimed is:

1. An anti-slip member for wearable equipment or sports equipment,
the anti-slip member including:
an elastomer composition comprising an elastomer and water-soluble particles dispersed in the elastomer;
a surface layer region comprising at least one of the water-soluble particles and recesses that are exposed on a surface of the surface layer region as a result of the disappearance of the water-soluble particles;
an internal region disposed inside the surface layer region; and
silica,
wherein a proportion of the water-soluble particles in the internal region is from 2 volume % to 4 volume %,
the water-soluble particles have an average particle size of from 10 to 45 μm, and
the elastomer composition further includes liquid paraffin, a silane coupling agent, zinc oxide, and isoprene rubber, and the water-soluble particles comprise an inorganic salt.

2. The anti-slip member according to claim 1, wherein the inorganic salt is sodium chloride.

3. The anti-slip member according to claim 1, wherein the elastomer has a tensile elastic modulus of 10 MPa or less.

4. Wearable equipment comprising the anti-slip member according to claim 1.

5. The wearable equipment according to claim 4, the wearable equipment being a shoe, wherein
the anti-slip member is disposed at a ground contact place of a shoe sole of the shoe.

6. The wearable equipment according to claim 5, wherein the anti-slip member is disposed at at least one of positions of the shoe sole configured to respectively correspond to a heel, metatarsophalangeal joints, and a toe, of a wearer.

7. Sports equipment comprising the anti-slip member according to claim 1.

8. The anti-slip member according to claim 1, wherein the elastomer composition has a hardness of 70 or less measured by a type A durometer according to JIS K 6253-3:2012.

* * * * *